United States Patent [19]

Perrault et al.

[11] 4,266,310

[45] May 12, 1981

[54] ARRANGEMENT FOR FORMING METAL PARTS

[76] Inventors: Frederick Perrault, 2644 W. 225th St., Torrance, Calif. 90505; Raymond E. Perrault, 2404 Colt Rd., Rancho Palos Verdes, Calif. 90274

[21] Appl. No.: 956,427

[22] Filed: Oct. 31, 1978

Related U.S. Application Data

[63] Continuation-in-part of Ser. No. 842,605, Oct. 17, 1977, abandoned.

[51] Int. Cl.[3] ..... B21D 53/24

[52] U.S. Cl. ..... 10/86 R; 10/152 R; 72/368; 72/51; 72/404; 113/116 H

[58] Field of Search ..... 72/51, 368, 379, 404, 72/472; 113/116 R, 116 H, 116 UT, 116 V, 116 HH, 119; 10/86 R, 152 R, 153; 29/413, 417

[56] References Cited

U.S. PATENT DOCUMENTS

| | | | |
|---|---|---|---|
| 652,658 | 6/1900 | Bischoff | 72/404 |
| 708,932 | 9/1902 | Smith | 72/368 |
| 786,923 | 4/1905 | Smith | 72/368 |
| 1,676,919 | 7/1928 | Persons | 10/86 R |
| 1,879,077 | 9/1932 | Carlsen | 72/368 |
| 2,077,335 | 4/1937 | Lemming | 72/391 |
| 2,826,810 | 3/1958 | Peterson | 29/413 |
| 3,665,881 | 5/1972 | Koch et al. | 113/119 |

*Primary Examiner*—Lowell A. Larson

*Attorney, Agent, or Firm*—Gausewitz, Carr, Rothenberg & Edwards

[57] ABSTRACT

In accordance with this invention a part having an internally threaded section is formed by a progressive stamping operation in which there is only opposed rectilinear motion between the punch and die, and no mandrel is used. The part may include a U-shaped receptacle portion and a prong element for being bent over an object that is supported. In producing the part, grooves are formed in the surface of the workpiece, being progressively deepened to the depth of the screw thread and with side wall portions progressively given the inclination of the flanks of the screw threads. The threaded portion then is given a concave shape at either of its two opposite edges and a convex shape in between. The convex shape subsequently is made concave as the threaded section is closed up. In these steps the part is engaged by punch elements in the form of threaded members which have ridges corresponding to the grooves in the workpiece. Finally, the opposite edges of the grooved portions of the workpiece are brought together and this portion of the workpiece is given a cylindrical shape by compressing it in opposed die openings, completing the threaded section.

139 Claims, 36 Drawing Figures

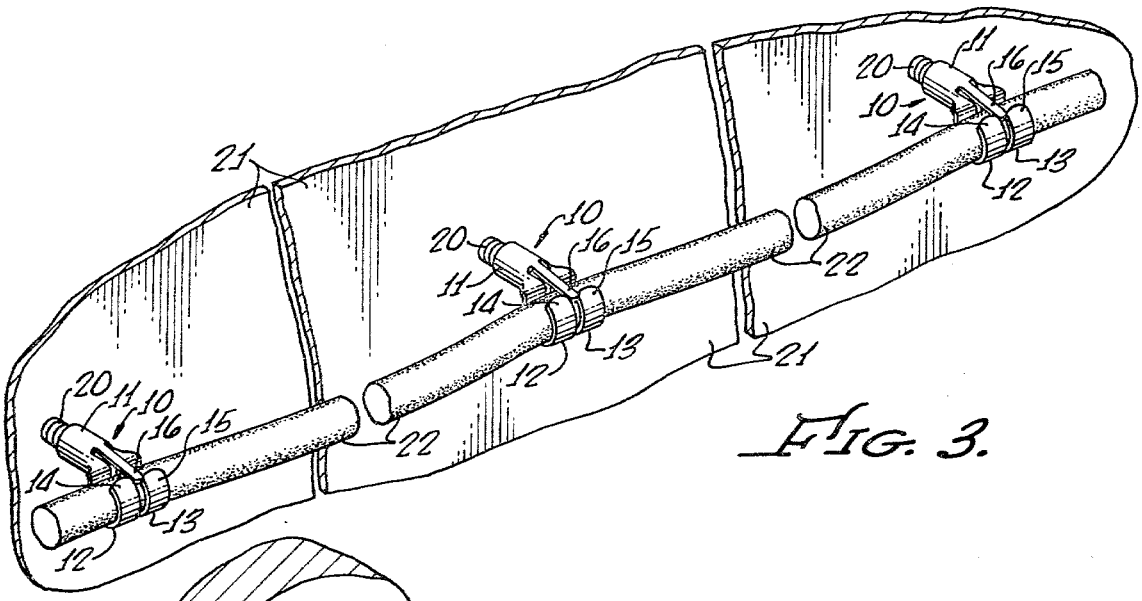
FIG. 3.
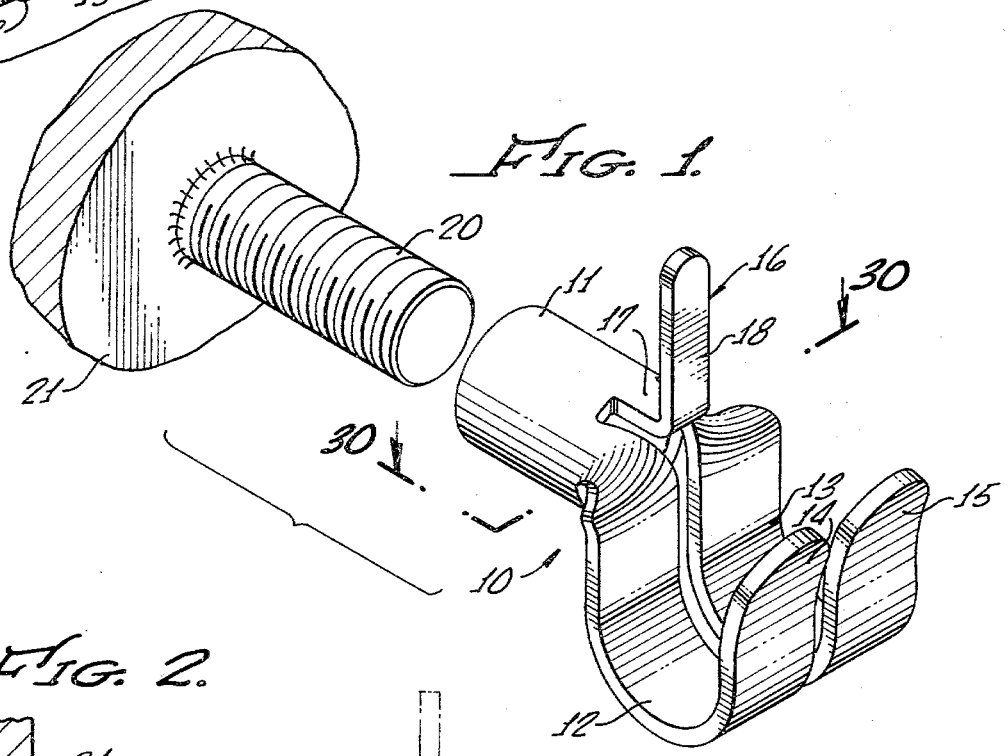
FIG. 1.
FIG. 2.
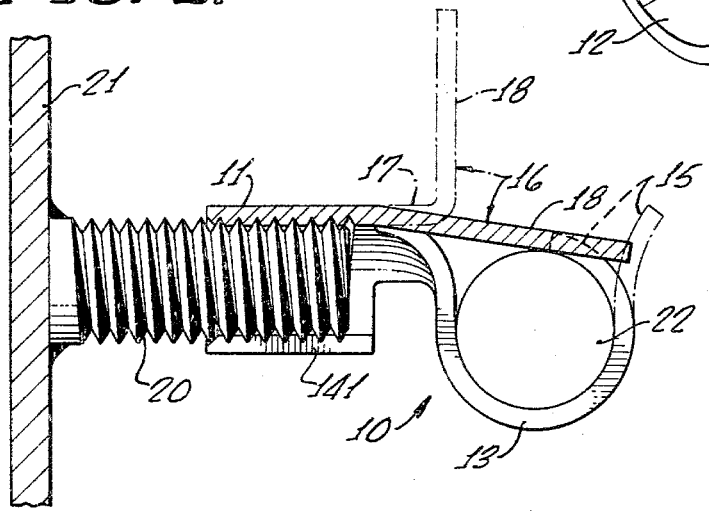
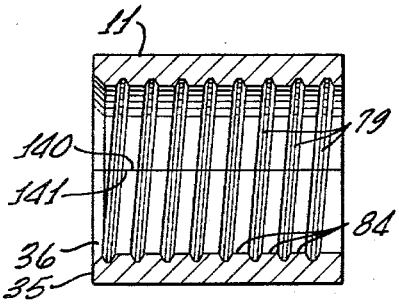
FIG. 30.

FIG. 9.
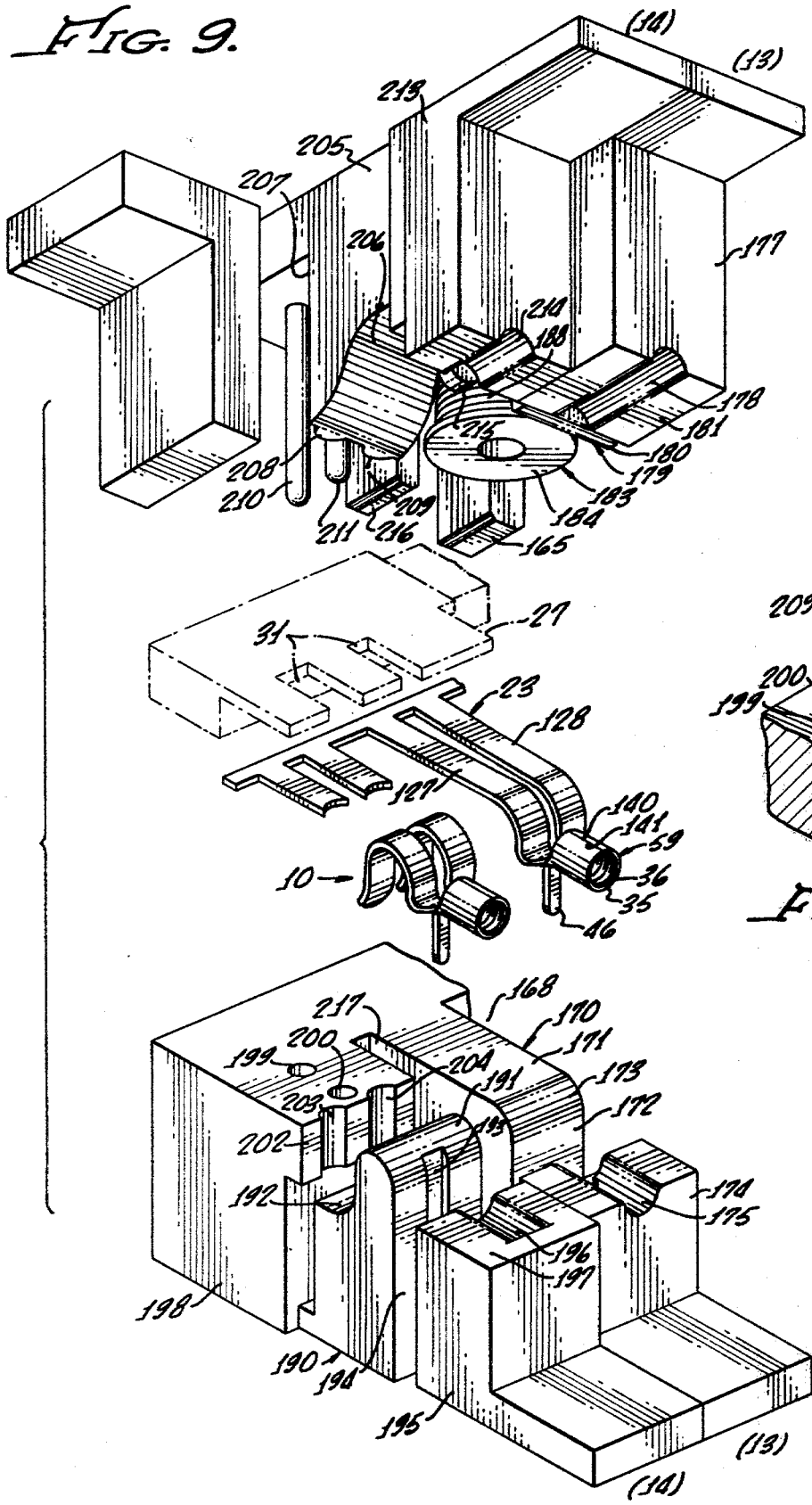
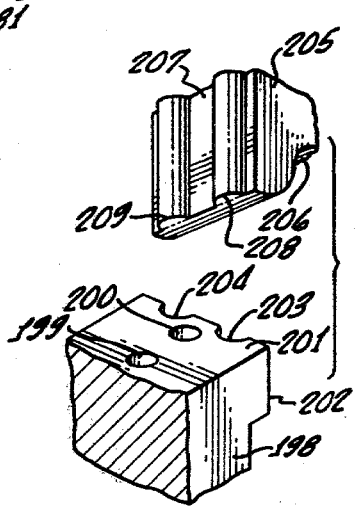
FIG. 29.

ARRANGEMENT FOR FORMING METAL PARTS

CROSS-REFERENCE TO RELATED APPLICATION

This is a continuation-in-part of application Ser. No. 842,605, filed Oct. 17, 1977, now abandoned.

BACKGROUND OF THE INVENTION

1. Field of the Invention

This invention pertains to the formation of threaded metal parts, to the method of forming, to the tooling employed, and to the resulting articles.

2. Description of the Prior Art

In the manufacture of threaded metal parts the conventional practice has been either to machine or roll the threads. This has been a major factor in the cost of such parts, because of the tooling, time, equipment, and material involved in such operations. The cost of threading is of particular significance where a part is adapted for economical production without machining, except for a threaded section. For example, there may be a part which in most aspects is adapted for production by stamping, but require a threaded portion for connecting it to an associated item. Conventionally, it is necessary either to machine the entire part or to stamp a portion of it and weld on a separately machined threaded element. In either event, the cost of the part is greatly increased. Additionally, when parts must be secured together, such as by welding, there is always a question as to the reliability of the connection and some of the parts may fail because of an improper weld.

There have been some efforts to produce threaded parts in another way, such as by engaging them with a die having a thread contour and then bending the part to assume a cylindrical shape. However, for anything approaching a part having a well-formed thread, accurately shaped and of adequate strength, these efforts have been unsucessful. Hence, the traditional machining techniques have remained predominant in the metal forming art.

SUMMARY OF THE INVENTION

The present invention provides an arrangement by which threaded parts may be obtained from sheet metal entirely through a stamping operation. Parts which conventionally would require drilling and tapping now can be produced by stamping in an automatic press. The result is a drastic reduction in the cost of producing the parts, much faster production, savings of material while obtaining parts of superior performance and better appearance.

In accordance with this invention, the sheet metal part is formed in a press in a progressive die arrangement. The portion to be threaded is struck by a punch having ridges on its lower surface. More than one punch may be used, progressively deepening the grooves in the workpiece until they correspond to the depth of the thread for the completed part. Also, the inclination of at least some of the walls of the grooves may be progressively made less steep to finally correspond to the inclination of the flanks of the threads. Where the threaded portion has an additional element attached to it, it is retained on one side and allowed to expand on the other, with the grooves initially being given a shallower inclination on the side where the restraint is present. Where no additional element is attached, the part may be caused to expand in both directions.

After the forming of the grooves to correspond to the thread, the part then is given a cylindrical contour, bringing the opposite edges together so that the grooves match and a continuous thread is produced. In doing this, it is initially provided with a concave curvature adjacent its outer edges and a convex curvature at the middle part. This is accomplished by positioning the workpiece adjacent die cavities of corresponding configuration and then forcing it into the cavities by a punch. The punch used may be threaded shanks, the threads of which correspond in shape to that of the grooves in the workpiece. This avoids damage to the part as the forming takes place. The sidewalls of the punch may be flattened in certain stages to allow clearance as the punch is withdrawn from the part and when the curvature begins to close up.

Finally, the part is wrapped around to the point that upon engagement of its exterior by opposite die surfaces, a cylindrical shape is imparted to it. This completes the production of the threaded section as the edges at the ends of the grooves are brought tightly together, with no gap between them. The end of each groove is aligned with the end of the adjacent groove at the seam, so that a continuous helical thread is produced.

In order to assure creation of a precise cylindrical shape, an excess of material is provided for the section being threaded so that it is compressed by the dies when formed into a sleeve. In other words, the distance between the edges of the workpiece prior to forming into a sleeve is made greater than the circumference required for the finished part. The resulting compression in the dies forces the periphery of the workpiece into intimate contact with the die surfaces and causes the edges to be tightly abutted at the seam.

Another advantage can be realized by making the threads tighter at the inner portion of the threaded section than at the entrance to the threads. This produces a self-locking effect as the tighter portion grips the threaded part with which it mates. The looser threads at the entrance permit easy initial engagement of the threaded parts. The fact that the threaded section has a longitudinal split enables it to resiliently grip the mating threaded part, without causing the threads to bind so as to prevent full engagement.

By forming the threads with die elements the threads on all parts are made the same. This means that the entrance to the threads always is at the same rotational position in the completed parts. In this respect the parts are unlike those produced with a tap or otherwise cut because then the thread entrance can be at any rotational position, depending upon where the cut happens to begin. A known entrance to the threads can be important by allowing the mated parts to be rotationally indexed at a predetermined angular position. For example, this permits the part to be installed to face in a predetermined direction when the threads are fully engaged or to allow a pin to fit through openings in the mated sections to lock them together in a predetermined angular relationship.

Among the numerous other advantages of the present invention are: (a) the threads are very high quality and strong, and are swaged instead of being cut, (b) the sheet metal workpiece does not curl or bend during the thread forming steps, thus all thread grooves have precisely the same cross-sectional shapes, and there is nothing (such as a bend or curl about an axis perpendicular to the thread grooves) to prevent the workpiece from being bent into the desired cylindrical shape, (c) die breakage is minimized and die life maximized, (d) relatively wide and long metal sheets may be threaded, and (e) numerous metals, for example steel, aluminum, brass and titanium, may be used as the workpiece.

A part advantageously produced in accordance with the invention is an improved hanger or bracket used for supporting a cable or other elongated object. The hanger includes a threaded sleeve portion, a U-shaped support and a tab, all of which are integral. The threaded sleeve portion connects to a stud attached to a bulkhead or other object, positioning the U-shaped support so that it is adapted to receive the cable. The connection is completed merely by bending the tab downwardly on top of the cable and, if desired, bending the ends of the U-shaped support inwardly over the cable. This securely retains the cable so that it will not become dislodged even from upward forces exerted on it. Preferably, the threads of the sleeve resiliently grip the stud to provide a self-locking effect.

BRIEF DESCRIPTION OF THE DRAWINGS

FIG. 1 is a perspective view of a supporting bracket produced in accordance with this invention, along a mounting stud to which it attaches;

FIG. 2 is a longitudinal sectional view showing the supporting bracket in the installed position;

FIG. 3 is a perspective view illustrating the use of several of the brackets of FIG. 1 in supporting a cable;

FIG. 9 is an exploded perspective view of the arrangement for forming the part at the thirteenth and fourteenth stages;

FIG. 29 is a fragmentary exploded perspective view showing the arrangement for cutting the part free from the workpiece at the fourteenth forming stage;

FIG. 30 is a longitudinal sectional view of the threaded sleeve portion of the completed part taken along line 30—30 of FIG. 1;

DESCRIPTION OF THE PREFERRED EMBODIMENT

Figure 4:
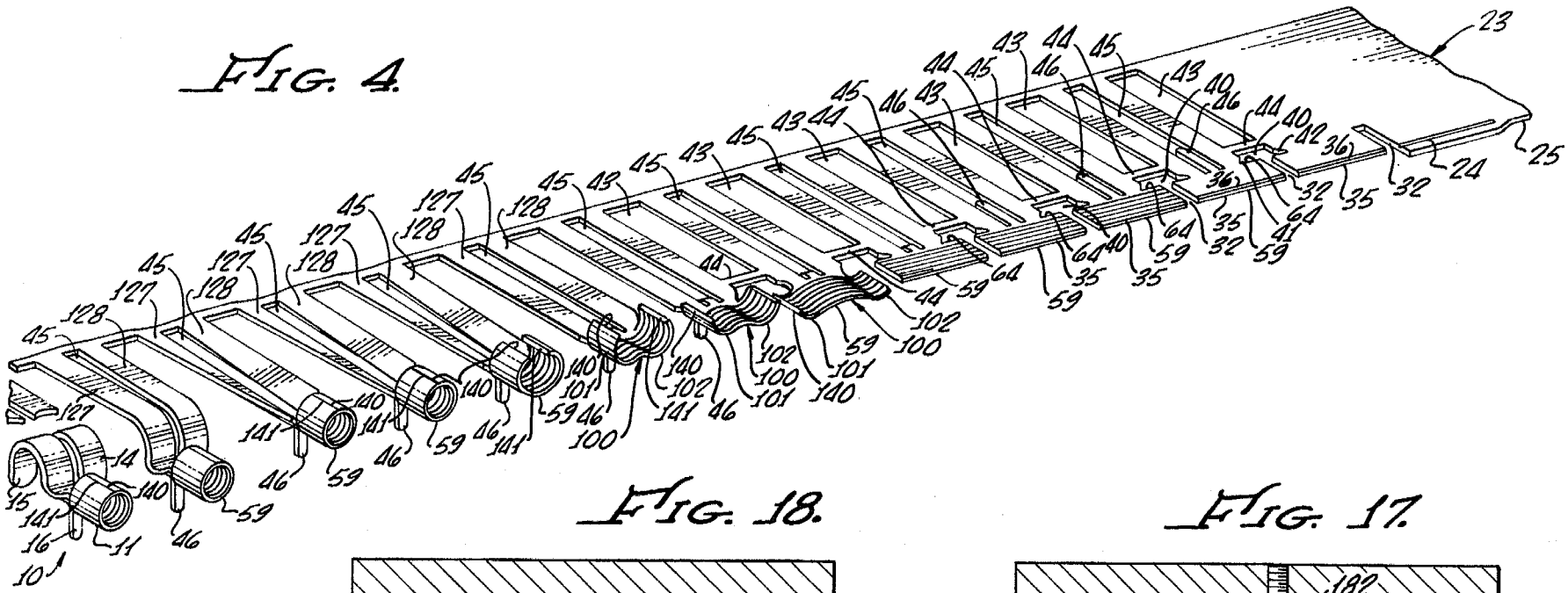
FIG. 4 is a perspective view of the workpiece for producing the bracket, illustrating the various stages of forming the part in the progressive die arrangement.

The part 10, shown in FIGS. 1, 2, and 3, is a bracket or hanger produced in accordance with the present invention, adapted to support a cable, tube, pipe, or the like. It includes an internally threaded cylindrical sleeve portion 11 from one end of which project two support members 12 and 13, which are side-by-side and generally U-shaped in side elevation and slightly divergent toward their outer ends. The outer tips 14 and 15 of the members 12 and 13 include a reverse bend away from the threaded section 11, which facilitates entry of an object into the support that the elements 12 and 13 provide. A tab 16 extends from the same end of the sleeve 11, having a base portion 17 parallel to the axis of the sleeve and an upstanding portion 18 at right angles to the base. Therefore, the tab 16 extends away from the U-shaped portion, leaving the latter portion open to receive the object to be supported. The sleeve 11, support members 12 and 13, and tab 16 are integral, being made from a single piece of sheet metal.

The hanger 10 is used by threading the section 11 onto a stud 20 which at its opposite end is fastened to a bulkhead 21, wall, ceiling or other supporting surface. Typically, several of the hangers 10 will be attached to the bulkhead at spaced intervals, as shown in FIG. 3. An object, such as an electrical cable 22, is inserted into the receptacles defined by the support elements 12 and 13. The connection is completed by bending the outer ends 14 and 15 of the members 12 and 13 around the cable 22 and deflecting the upstanding portion 18 of the tab 16 downwardly over the top of the cable. The bending is accomplished very easily and rapidly with pliers or a hammer. This provides a very secure attachment of the hangers 10 to the cable 22, holding the cable so that it will not be dislodged by upward forces tending to drive it out of the supports.

The hangers 10 are produced from sheet metal strip stock fed from a coil through a progressive die arrangement actuated by a reciprocating press. There are multiple stages in producing the completed parts 10, there being fourteen stages in the example described below. The number of stages necessary will depend upon the size and shape of the part, as well as the material from which it is made, and may be more or less than the fourteen stages described. At each stage part of the forming takes place so that as the strip of material is advanced the parts 10 are produced in increments. The punch includes a number of individual punch elements which move simultaneously in parallel paths as the press makes its downward stroke, cooperating with dies below to accomplish the various forming stages. All of the contouring of the workpiece, including the creation of a cylindrical threaded section, is accomplished by moving the punch rectilinearly toward and away from the die. No mandrel or other internal tool is used even though an accurately formed threaded section is produced.

FIG. 4 illustrates the strip of material 23 as it is formed in the various stages in producing the parts 10 in this manner. The progressive die technique means that with each stroke of the press a completed part is obtained. The result is extremely rapid production at a fraction of the cost of conventional manufacturing operations. At the same time, the parts are of superior quality and offer advantages not realized with ordinary manufacturing procedures.

In the first forming stage a longitudinal groove 24 is formed in the upper surface of the strip material 23 adjacent its longitudinal edge 25. This is accomplished by the components seen in FIG. 5, where the material 23 is fed over a flat lower die surface 26 beneath a stripper 27. The punch includes a V-shaped section 28 with a flattened bottom edge 29. Spaced inwardly is a punch element 30 which has a flat lower surface. When the punch moves downwardly to strike the part, the portion 30 holds the part on the surface 26 as the V-shaped element 28 produces a complementary groove 24 in the upper surface of the workpiece 23. The contour of the punch 28, with its flattened bottom edge 29, causes the groove 24 to have a flat bottom wall with two side walls diverging from it. The compression of the material of the workpiece 23 displaces the edge 25 outwardly a slight amount, as shown.

As the punch is raised, the stripper 27 holds the part down on the dies so that it will not lift up with the punch. The stripper 27 extends over the workpiece 23 in all of the forming stages, having suitable slots and openings 31 to allow movement of the punch, as appears in the various views of the drawing. The function of the stripper 27 is the same at each forming stage, for which reason no further description of the stripper is included.

With the punch raised, the strip 23 of material is advanced longitudinally a distance equivalent to the width of each of the die stages, as described below, after which it is held stationary and the punch again descends.

Figure 5:
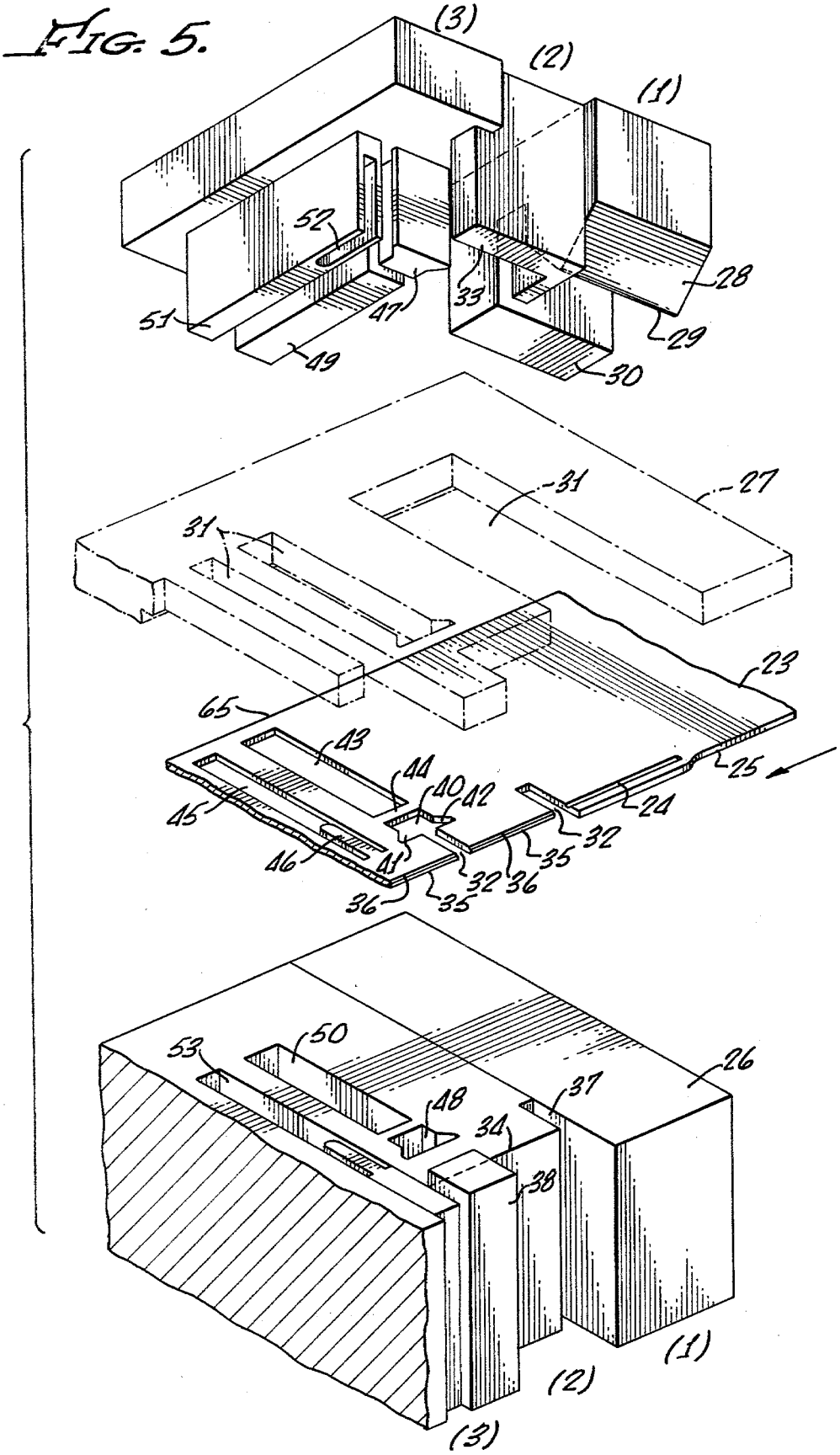
FIG. 5 is an exploded perspective view of the arrangement for forming the workpiece in the first, second, and third stages.

In the second stage, the outer portion of the strip 23, beyond the groove 24, is cut off and a transverse slot 32 is formed. This is accomplished, as shown in FIG. 5, by an L-shaped blade 33 which is aligned with a complementary L-shaped die edge 34. The workpiece 23 is positioned so that the outer half of the groove 24 extends just beyond the longitudinal part of the edge 34. Consequently, when the blade 33 descends, it shears off the outer part of the workpiece 23 at the center of the groove 24, leaving an outer edge 35 on the workpiece with a bevel 36 at its upper portion. The bevel 36 provides an entrance to the threads in the sleeve portion 11 of the completed part 10, as well as causing the threads to be recessed a short distance inwardly of the sleeve end for their protection. Providing the groove 24 with a flat bottom wall avoids the creation of a sharp edge when the outer part is cut off. The slot 32, at right angles to the edge 35, is sheared out at the same time by the movement of the blade 33 past the transverse portion of the die edge 34 into a die opening 37.

Figure 25:
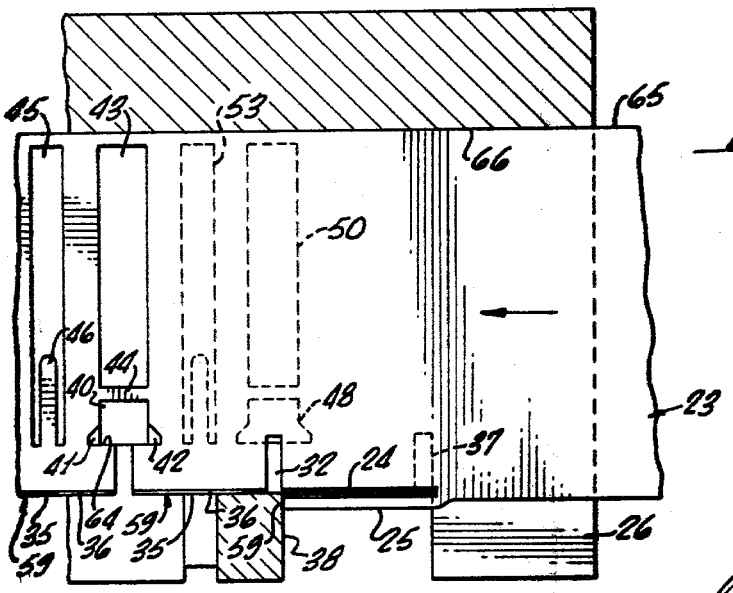
FIG. 25 is a fragmentary plan view showing the workpiece on the dies engaging the stop which indexes the workpiece longitudinally.

Between the second and third stages is a stop 38 which is used in indexing the workpiece longitudinally in the press for each stroke. The stop 38 is a vertical member positioned just outwardly of the groove 24 in the workpiece (see FIGS. 5 and 25). The strip of material 23 is continuously biased longitudinally into the dies, so that when the punch is lifted the workpiece is advanced automatically. This movement continues until the forward edge 59 (FIG. 25) of the workpiece, between the groove 24 and the outer edge 35, strikes the stop 38. Upon the next downward stroke of the press, the edge portion beyond the groove 24 is cut off by the blade 33, as described above, freeing the workpiece to advance again upon the upward stroke. The edge 35 of the workpiece, after the outer part is cut off, just clears the inner face of the stop 38 with the opposite longitudinal edge 65 of the workpiece being guided by a vertical surface 66 of the die assembly.

In a third forming stage, additional cuts are made in the workpiece, producing and shaping various openings. This includes an opening 40, communicating with and inwardly of the slot 32, this opening having flared portions 41 and 42 on the side facing the slot 12. Aligned with and of the same width as the inner portion of the opening 40 is an elongated rectangular opening 43 in the workpiece, which leaves a transverse interconnecting strip 44 between the openings 40 and 43.

Adjacent to the opening 43 and parallel to it is an additional and thinner opening 45, which is rectangular except that at the end adjacent the opening 40 there is a narrow prong 46 left which projects into the opening 45 along its longitudinal axis.

Figure 15:
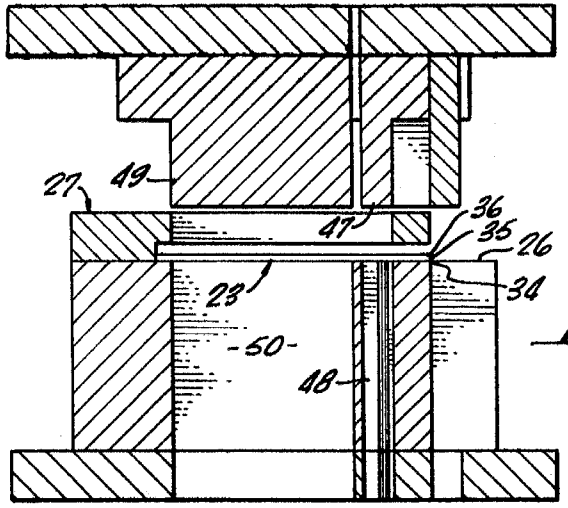

A punch section 47 is of a shape to produce the opening 40 in the workpiece when driven downwardly into a complementary die opening 48. A rectangular punch portion 49, aligned with a similar die opening 50, produces the opening 43 in the workpiece (FIG. 15). An additional punch portion 51 is used for producing the opening 45, and for this reason has a longitudinal recess 52 at one end for forming the prong 46. A die opening 53 is complementary to this part of the punch to enable the opening 45 and its prong 46 to be formed.

Grooves are formed in the upper surface of the workpiece 23 along its edge portion inwardly of the bevel 36, in the next three forming stages, which result in screw threads when the sleeve portion 11 of the hanger 10 is formed subsequently. Accordingly, the grooves are at a shallow angle to the edge 35 of the workpiece so as to interconnect and produce a helix when this portion of the workpiece is given a cylindrical shape. Also, they are spaced apart the distance of the pitch of the threads.

Figure 6:
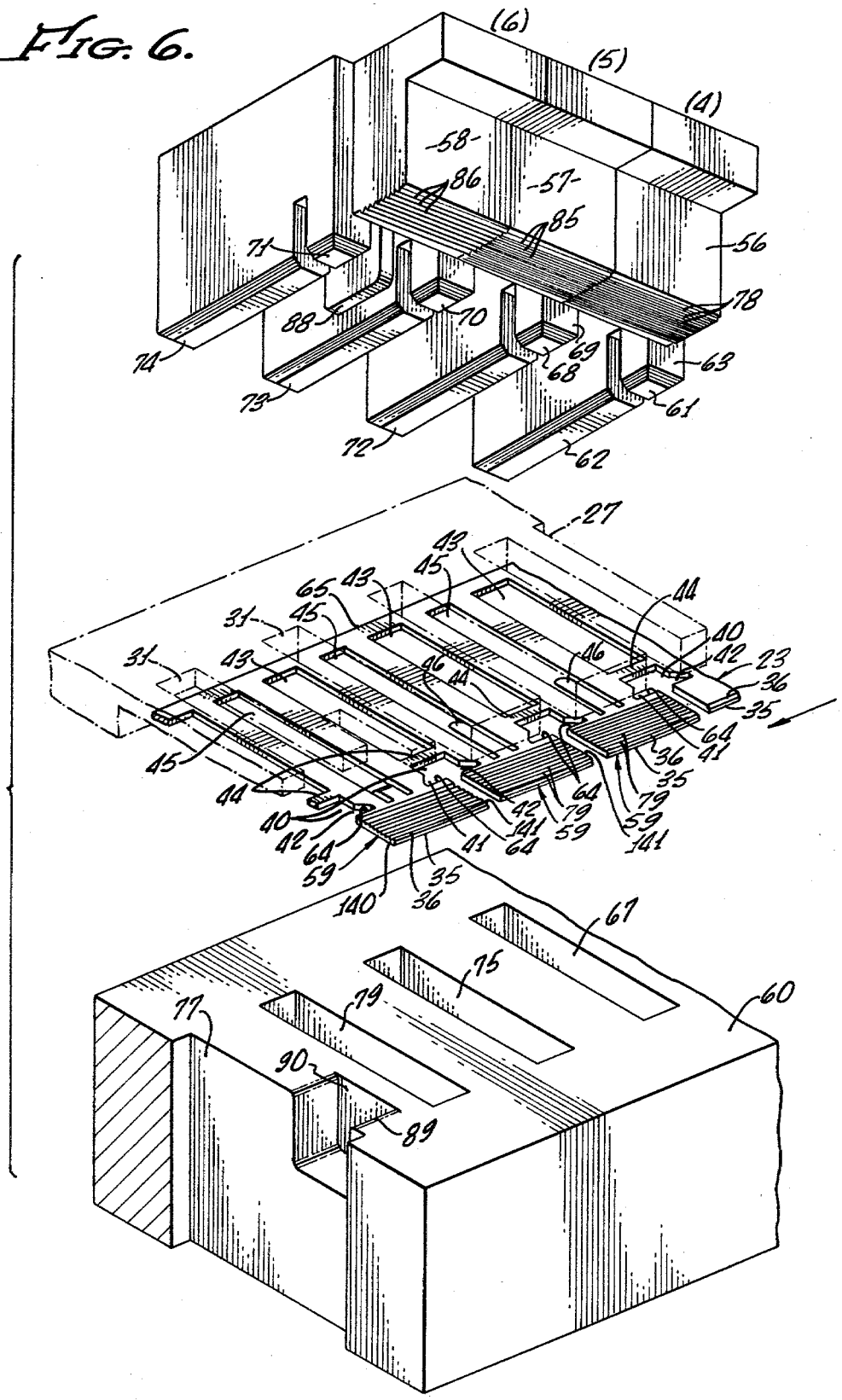
FIG. 6 is an exploded perspective view of the arrangement for forming the part in the fourth, fifth, and sixth stages.

Punches 56, 57, and 58 progressively form the threads in the fourth, fifth, and sixth stages, respectively, as seen in FIG. 6. The rectangular outer part 59 of the workpiece 23, beyond the openings 40, is supported on a flat die surface 60 during these stages. There are, in addition, pilots which accurately position the workpiece and restrain it during the fourth, fifth, and sixth forming stages. In the fourth stage, pilots 61 and 62, which have beveled lower corners, enter the openings 40 and 43 in the workpiece, straddling the strip 44 of the workpiece. This positions the flat vertical surface 63 of the pilot 61 next to the edge 64 of the workpiece opening 40 on one side of the workpiece section 59 at the fourth stage. A rectangular die opening 67 receives the lower portions of the pilots 61 and 62 upon the downward stroke of the press.

On the other side of the workpiece section 59 at the fourth stage, a pilot 68 enters the opening 40 of the workpiece to position its flat vertical surface 69 alongside the edge 64 of the workpiece. The pilot 68 is the same as the pilot 61. Its surface 69 also is next to the edge 64 on one side of the workpiece section 59 of the fifth stage when the press is in its downward stroke. Additional pilots 70 and 71 are the same as the pilots 61 and 68, fitting next to the edges 64 during the fifth and sixth stages.

Inwardly of the pilots 68, 70, and 71 are pilots 72, 73, and 74, respectively, which are the same as the pilots 62 and adapted to enter the workpiece openings 43 during the fourth, fifth, and sixth stages. Die opening 75 receives the pilots 68 and 72, die opening 76 receives the pilots 70 and 73, and die opening 77 is for pilots 71 and 74.

Figure 19:
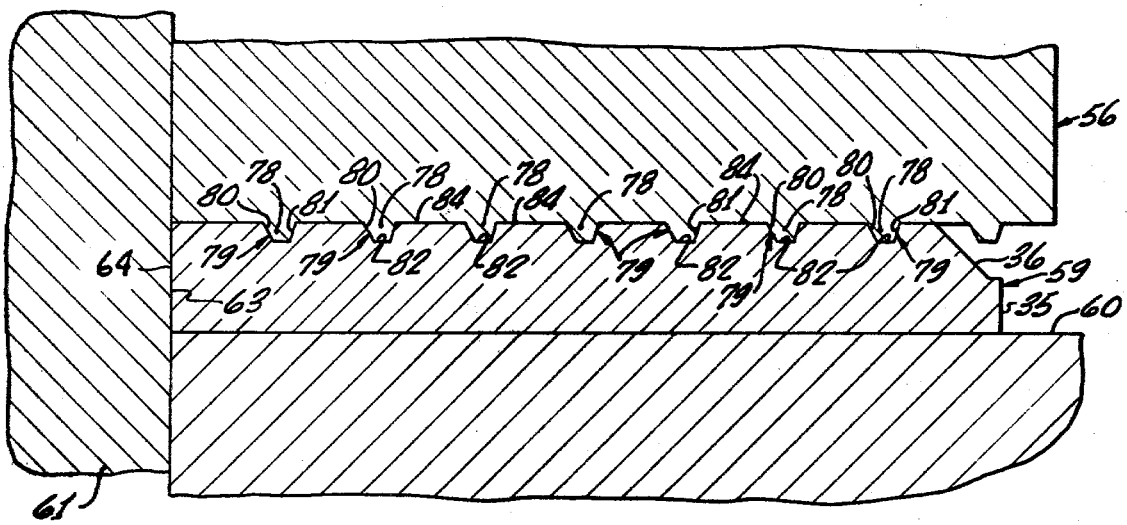
FIGS. 19, 20 and 21 are enlarged fragmentary sectional views, illustrating the formation of the grooves for the threads at the fourth, fifth, and sixth stages, respectively.
Figure 22:
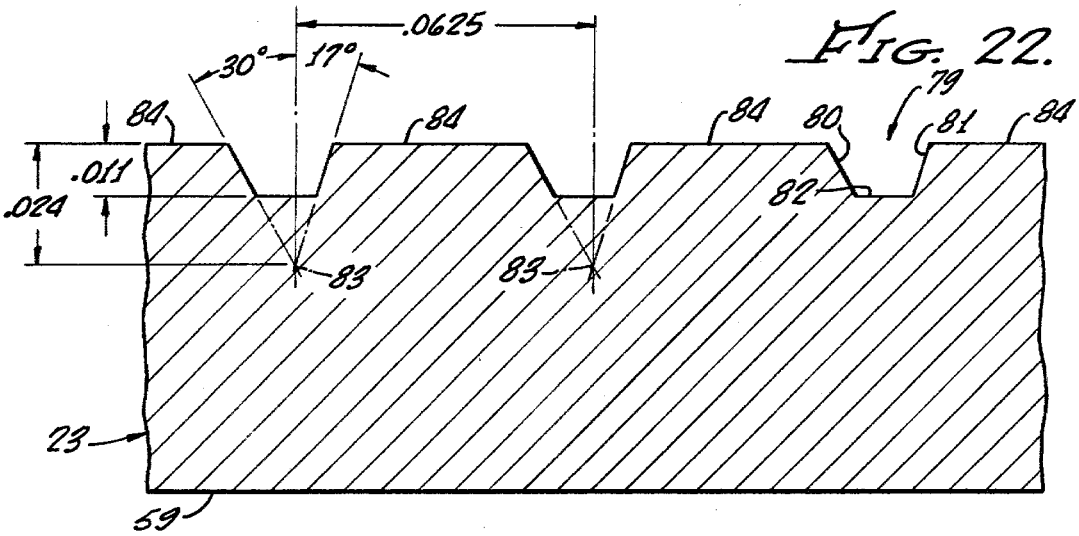
FIGS. 22, 23, and 24 are enlarged fragmentary sectional views showing the contours of the grooves in the workpiece at the fourth, fifth, and sixth stages, respectively.

The first thread formation step at stage four is shown in enlarged sectional views, FIGS. 19 and 22. As the punch 56 strikes the outer part 59 of the workpiece at stage four, portions of the workpiece become compressed. The punch surfaces 63 and 69, being adjacent the workpiece edges 64, restrain the outer part 59 of the workpiece from movement inwardly from the compression. Outward expansion of the workpiece can take place, however, as the outer workpiece edge 35 is unconstrained.

Parallel ridges 78 on the undersurface of the punch 56 form complementary grooves 79 in the outer part 59 of workpiece 23. On the inner sides of the grooves 79, that is the sides of the grooves adjacent the openings 40, where the workpiece is restrained against lateral movement, straight sloping walls 80 are formed at an angle of 30° relative to a line perpendicular to the upper surface of the workpiece, i.e., to the direction of movement of the punch. The opposite walls 81, on the side where the workpiece is unconstrained, are more steeply sloped at an angle of 17° to the vertical. Flat bottom walls 82 interconnect the outwardly diverging sidewalls 80 and 81.

The projections of the sidewalls 80 and 81 intersect at lines 83 below the bottom walls 82 of the grooves, as shown in FIG. 22. These intersections of the groove walls are spaced apart a distance equal to the pitch of the thread to be produced. In the example shown, the adjacent intersecting lines 83 are spaced apart 0.0625 inch (the pitch of the thread) and the bottom walls 82 are 0.011 inch below the upper surface 84 of the workpiece, upon forming at the fourth stage.

Figure 20:
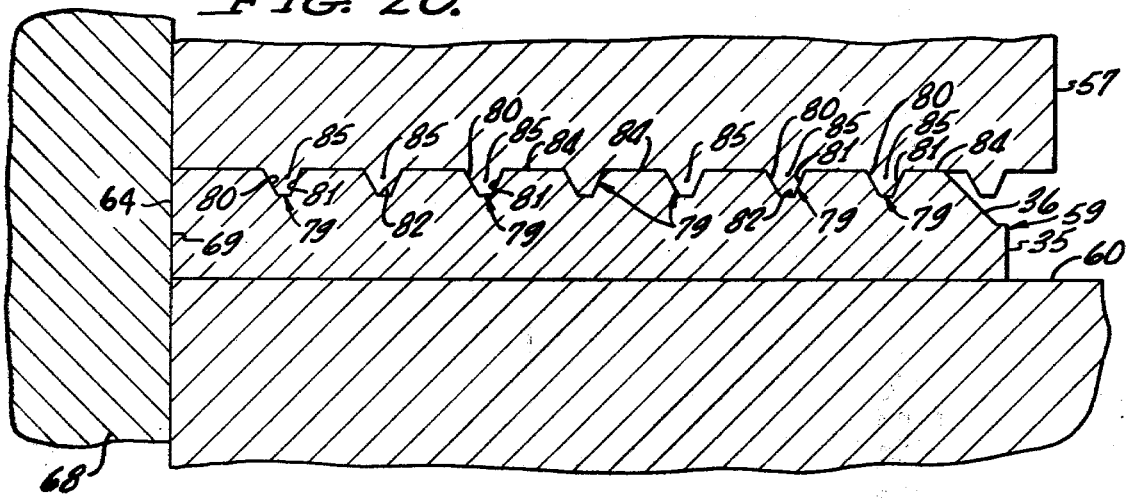
Figure 23:
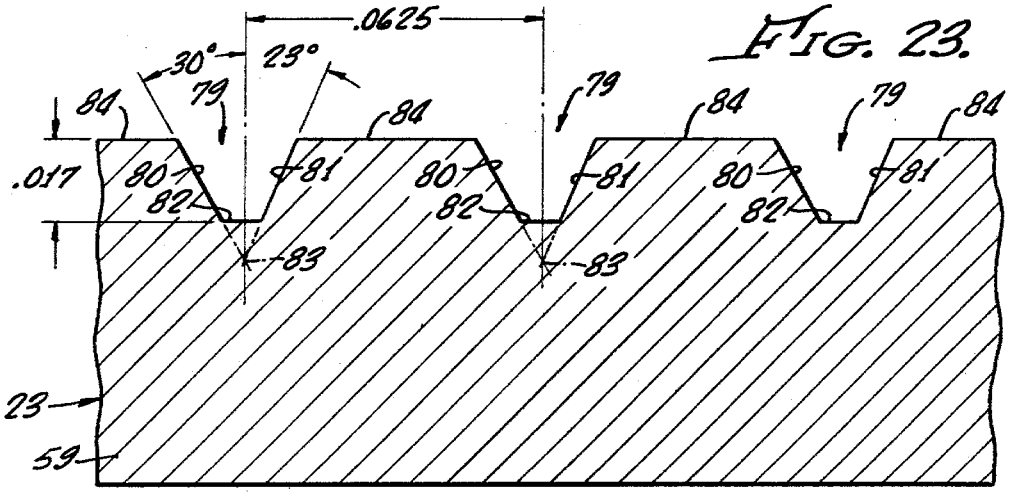

At the fifth forming stage, where the workpiece is struck by the punch 57, inward movement is again prevented as the outer part 59 of the workpiece is engaged by the punch and compressed in further forming the thread grooves. This restraint is accomplished by the pilots 68 and 70, in the manner illustrated in FIG. 20. The ridges 85 on the bottom of the punch 57 form the grooves 79 deeper than in the fourth stage, making the bottom walls 82 narrower and depressed further beneath the upper surface 84 of the workpiece. The groove depth is 0.017 inch in the example given (FIG. 23). At the same time the grooves 79 are widened by increasing the angle on the outer wall 81° to 23°. The inner walls 80, however, remain at an angle of 30°.

Even though the workpiece section 59 expands outwardly at the edge 35, the position of the grooves 79 remains unchanged. In other words, the ridges 85 on the punch 57 have locations corresponding to the ridges 78 of the punch 56.

At the final thread forming step of stage six, the ridges 86 on the punch 58 deepen the grooves 79 and widen them by imparting a 30° angle to the outer walls 81 of the grooves. Again, the inner groove walls 80 continue to have a 30° slope. The bottom walls 82 of the grooves are sunk substantially to the full depth of the thread, 0.019 inch in the example illustrated, although a minor amount of thread deepening occurs during some of the bending stages, as explained below. At the sixth stage, the bottom walls 82 are made more narrow than at the fifth stage, notwithstanding the fact that the total groove width is increased. The intersecting lines 83 of the sidewall projections remain spaced apart the distance of the pitch of the threads to be produced. The result is that the sidewalls and bottom walls of the grooves 79 define a desired thread configuration, such as that of a conventional screw thread formed by cutting or rolling. The roots of the threads are provided by the bottom walls 82 of the grooves and the upper surface portions 84 between the grooves 79 act as the crests of the threads.

In the sixth forming stage, as in the fourth and fifth, the inner edge 64 of the outer part 59 of the workpiece is restrained so that increased lateral dimension can occur only in the outward direction. The restraint is accomplished by the pilots 70 and 71 at the sixth stage. The ridges 86 in the punch 58 correspond in locations to the ridges 78 and 85 of the punches 56 and 57, so that the grooves 79 do not shift positions at the sixth stage.

The progressive thread formation at the fourth, fifth, and sixth stages, deepening the grooves and changing the flank angles, is important in achieving accurate thread contouring. Also, when the completed part has an operative element beyond the threaded section, such as the U-shaped supports 12 and 13, there should be restraint against lateral expansion of the threaded section on the side of such an element, with expansion being allowed in the other direction, so that the material of the workpiece will flow properly during the formation of the grooves to enable the grooves to be given the desired shape while avoiding die breakage.

Figure 16:
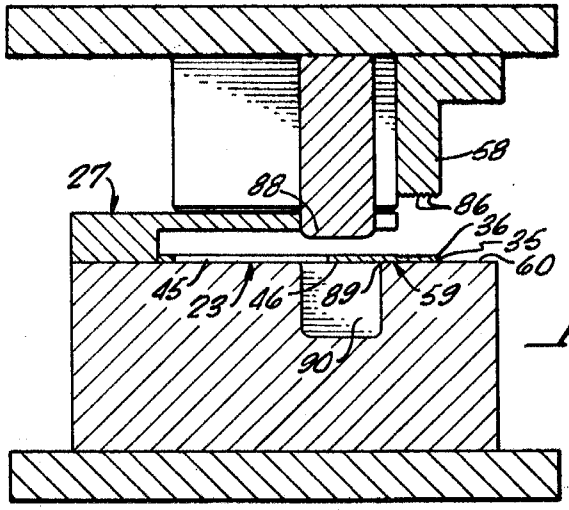
Figure 12:
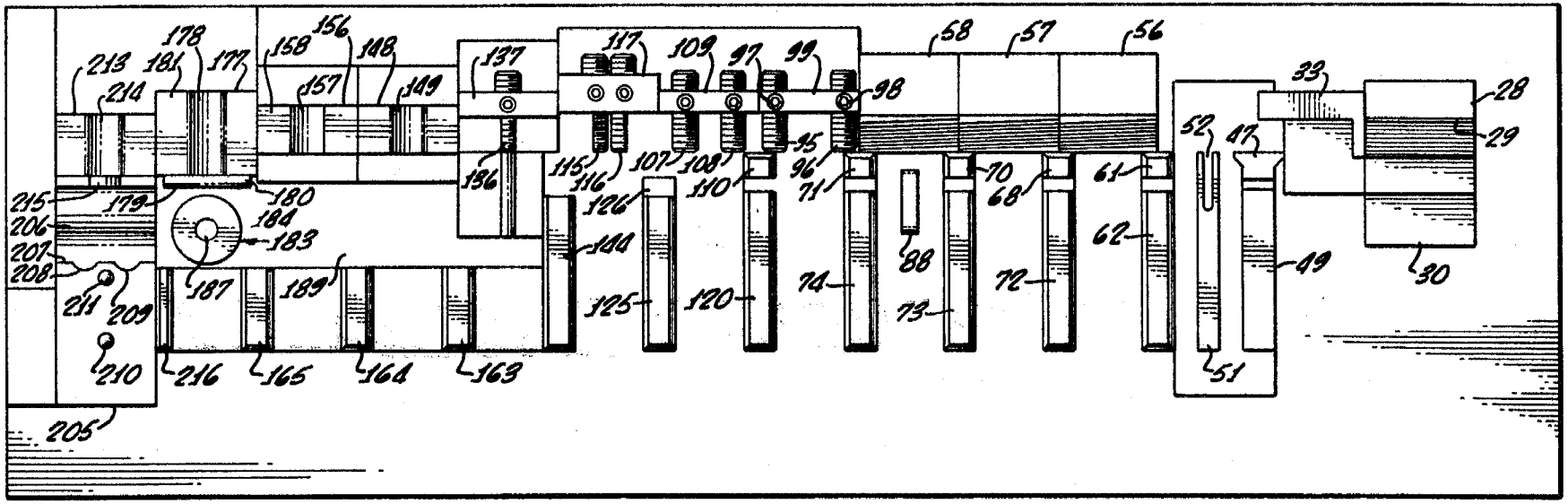
FIG. 12 is a plan view of the punch assembly for forming the part.
Figure 13:
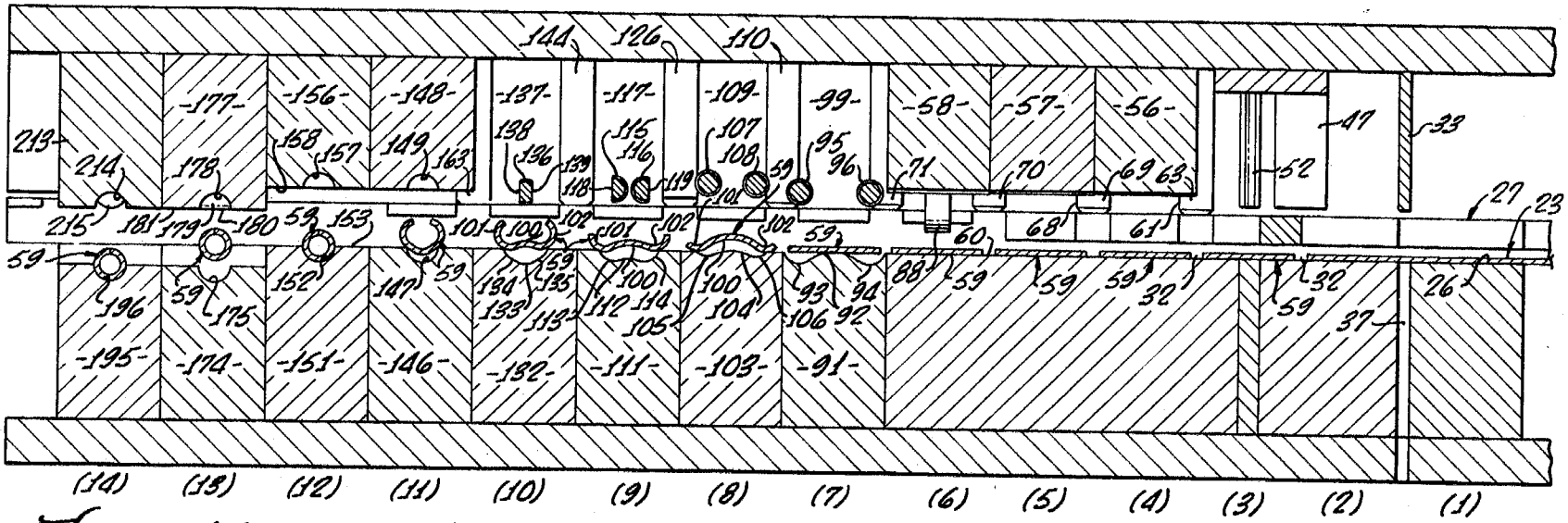
FIG. 13 is a longitudinal sectional view taken along line 13—13 of FIG. 10, but with the punch and workpiece added to illustrate the various forming stages, with the punch at the upper end of its stroke.
Figure 14:
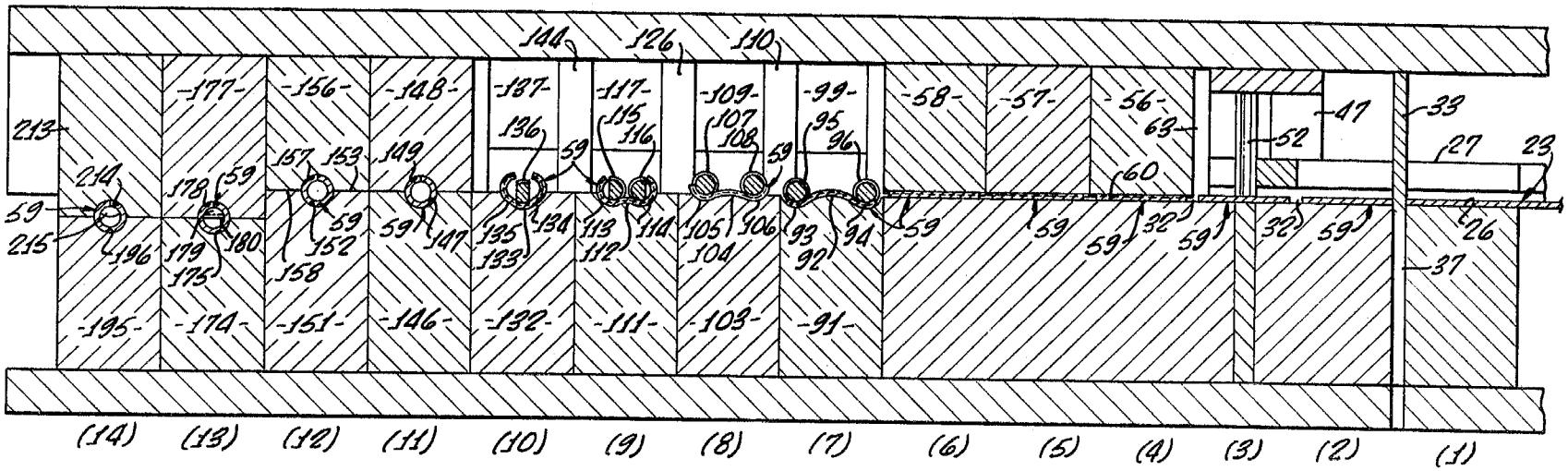
FIG. 14 is a sectional view similar to FIG. 13, illustrating the various forming stages with the punch at the bottom end of its stroke.

Additionally, at the sixth stage, the outer portion of the prong 46 is bent downwardly at an angle of 90°. This bend is made by a punch element 88, which deflects the prong about a curved die edge 89 into a die opening 90 (see FIG. 16).

The seventh stage (FIG. 7) is the first in contouring the outer part 59 of the workpiece, ultimately to give it the cylindrical configuration necessary to form the sleeve portion 11 of the completed part 10. The die 91, at the seventh stage, has an upper surface with a convex portion 92 at the center and concave parts 93 and 94 at the outer edges. These curved die surfaces are segments of cylinders with their axes perpendicular to the longitudinal workpiece edge 35. The punch in this instance is defined by two horizontal threaded studs 95 and 96, which are threaded into openings in a vertical flange 99 and are locked by set screws 97 and 98. This positions the studs 95 and 96 above the concave die surfaces 93 and 94, respectively. The threads of the studs 95 and 96 are of a pitch and configuration to match the grooves 79 in the workpiece, with which they are aligned. Consequently, when the outer part 59 of the workpiece is struck by the studs 95 and 96, it is deflected over the convex die surface 92 and into the concave edge portions 93 and 94, but the shape of the grooves 79 remains unchanged. The shape of the die cavity is given the workpiece even though less than the full area of the upper workpiece surface is struck by the punch. This forming step gives the workpiece a convex central portion 100 and concave upwardly curled edge portions 101 and 102.

At the eighth forming stage, the central portion of the workpiece remains convex upwardly and the outer portions are given a greater upward concave curl. The die 103, at the eighth stage, has an upper surface which has a narrower convex central portion 104, and outer concave portions 105 and 106, which are closer to the center of the die than are the concave edge portions of the die 91. Studs 107 and 108, held on a support flange 109, act as the punch and are similar to the studs 95 and 96. However, the studs 107 and 108 are closer together to correspond to the positions of the surfaces 105 and 106 of the die 103.

Figure 7:
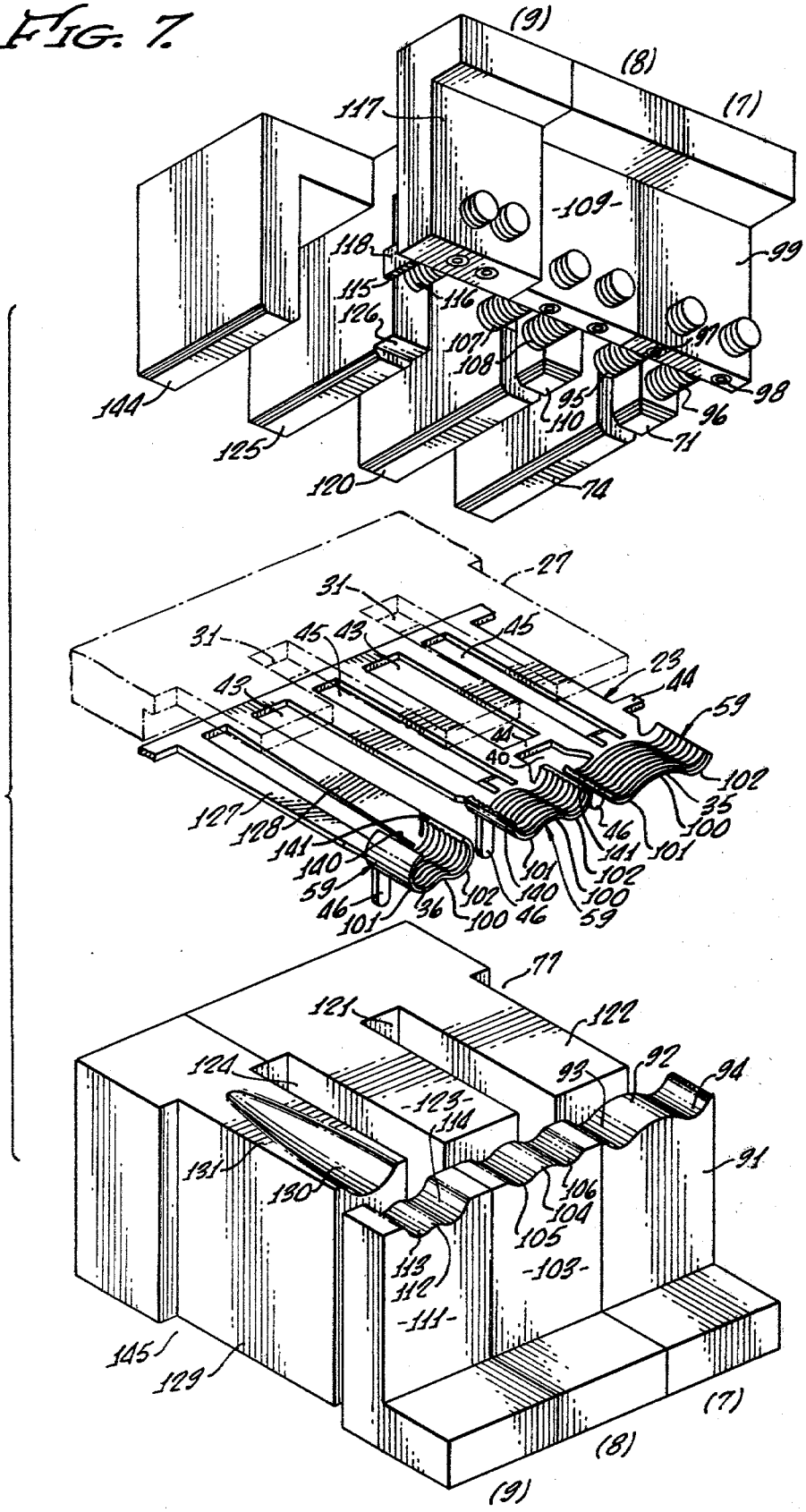
FIG. 7 is an exploded perspective view of the arrangement for forming the part at the seventh, eighth, and ninth stages.

As the workpiece is struck by the punch, again the threads are not affected because the studs are complementary to them. The side edge portions 101 and 102 are bent upwardly a greater amount as the studs 107 and 108 engage the outer part 59 of the workpiece closer to its center than at the seventh stage. This workpiece configuration, as shown in FIG. 7, has a narrower convex central portion 100 and more curvature to its outer side edge portions 101 and 102.

At the ninth forming stage, additional forming of the outer part 59 takes place, as the cylindrical sleeve end of the workpiece begins to close. The die 111 has a relatively narrow central convex portion 112 and deeper side edge concave portions 113 and 114. The portions 113 and 114 are closer to the center of the die 111 than are the portions 105 and 106 with respect to the center of the die 103. Studs 115 and 116, positioned above the die surfaces 113 and 114, act as the punch elements, supported on a vertical flange 117.

Figure 26:
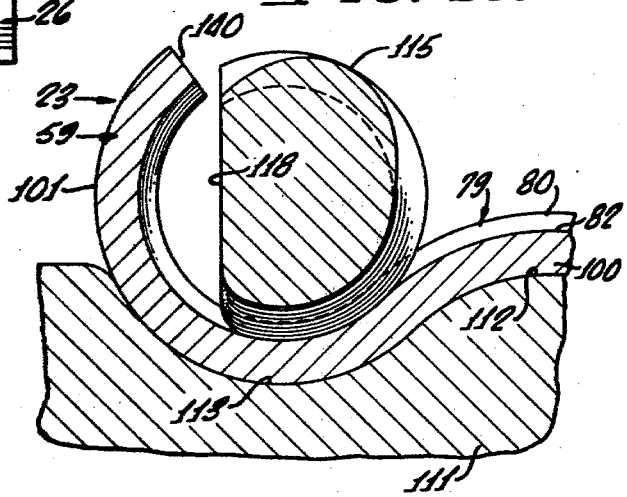
FIG. 26 is an enlarged sectional view showing one of the punch elements engaging the workpiece at the ninth forming stage.

Because the curvature of the workpiece begins to close at the ninth forming stage, the outer side portions of the studs 115 and 116 are cut away to provide flat surfaces 118 and 119 to give the studs 115 and 116 clearance for removal on the upward stroke. The thread grooves are continued for a distance into the flat surfaces 118 and 119, as seen in FIG. 26, so that damage to the threads of the workpiece will not occur as it is caused to bend upwardly around the studs 115 and 116. The outer part 59 of the workpiece, therefore, at the conclusion of the ninth forming stage, has edge portions 101 and 102 which curl inwardly and overlap part of the bottom portion of the outer part 59 of the workpiece.

Pilots 71 and 110 enter the openings 40 and pilots 74 and 120 enter the openings 43 of the workpiece during the forming at the seventh and eighth stages. Die opening 77 receives the pilots 71 and 74, and pilots 110 and 120 are received in opening 121. The inner portion of the workpiece rests on flat upper die surfaces 122 and 123.

Just beyond the die surface 123 is an opening 124 which is entered by a punch element 125 upon the downward stroke of the press. The rearward portion of the punch 125 is beveled and acts as a pilot. The forward part 126 is flattened, however, and aligned with the strip 44 of the workpiece that separates the workpiece openings 40 and 43. Consequently, the punch part 126 shears off the strip 44 upon the downward stroke. This leaves the outer part 59 of the workpiece connected to elongated strips 127 and 128, located one on either side of the prong 46.

Inwardly of the die 111 at the ninth stage, there is a die 129 having an arcuate elongated recess 130 in its flat upper surface 131. This recess is deeper at its outer end, adjacent the die 111, than at its inner end. As the outer part 59 of the workpiece is shaped at the ninth stage, the strips 127 and 128 are pulled down into the recess 130 and twisted to somewhat follow the curvature of the outer part 59.

Figure 8:
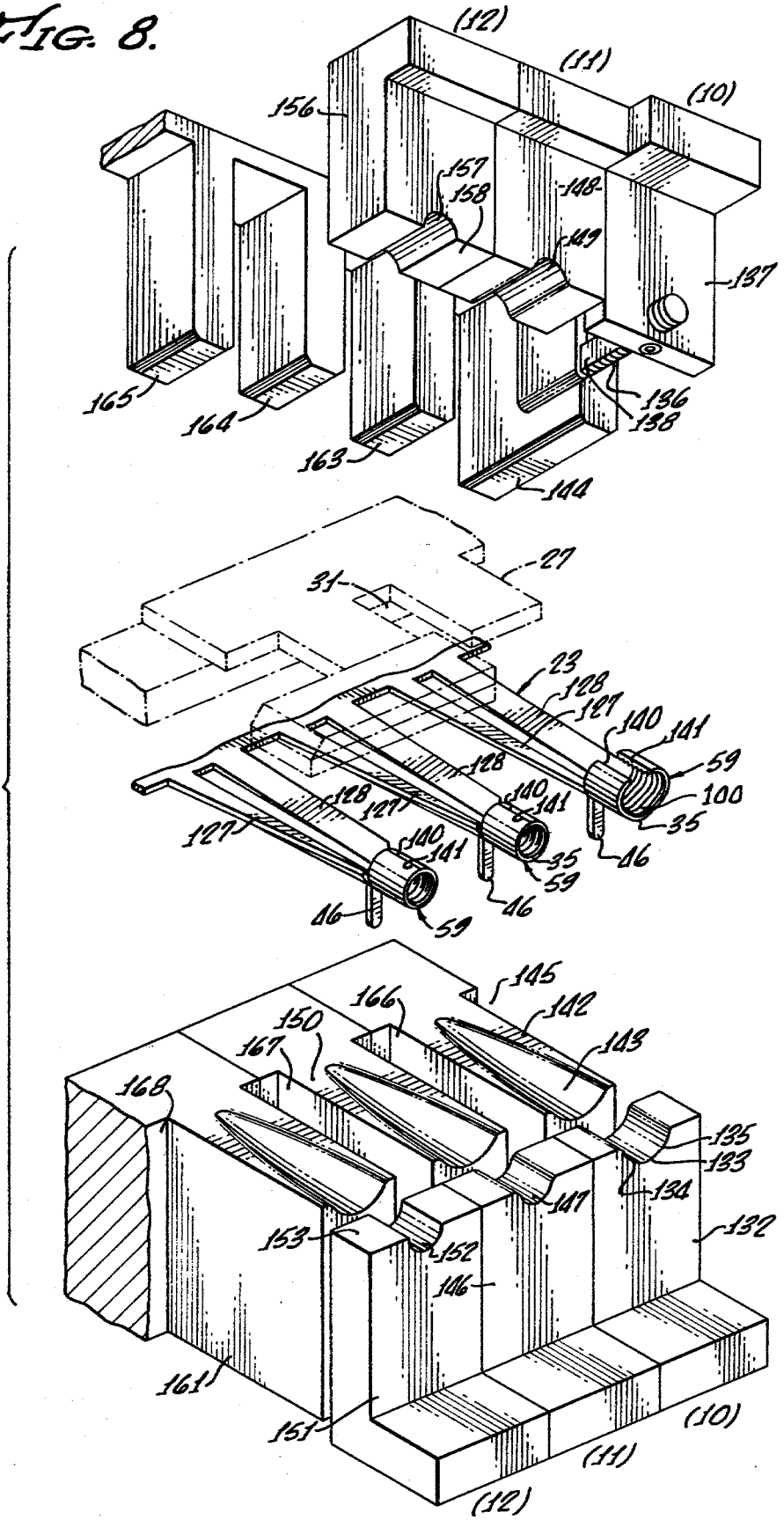
FIG. 8 is an exploded perspective view of the arrangement for forming the part at the tenth, eleventh, and twelfth stages.
Figure 11:
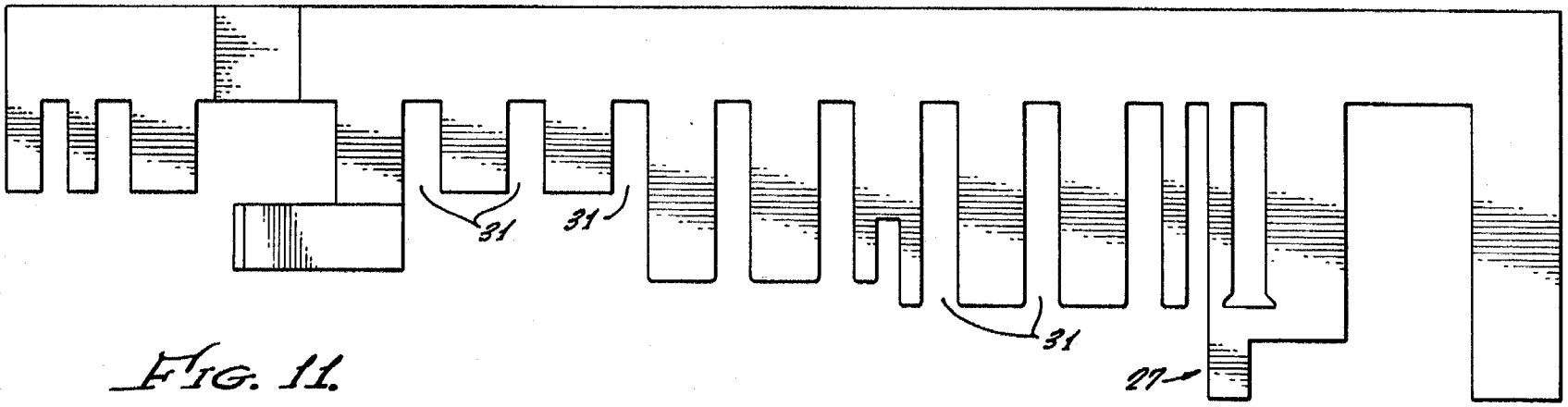
FIG. 11 is a plan view of the stripper for separating the workpiece from the punch as the press is raised.
Figure 10:
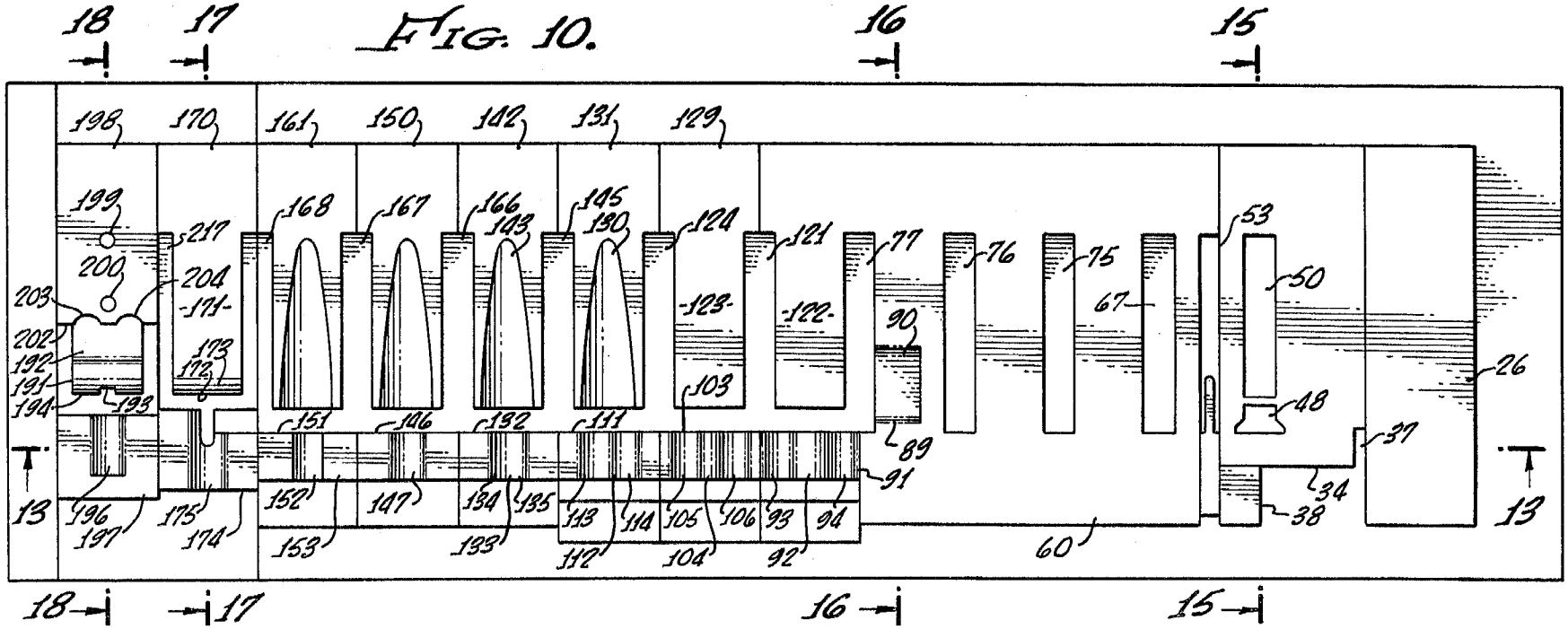
FIG. 10 is a plan view of the dies used in producing the part.

The tenth die stage (FIG. 8) further wraps the end portion of the workpiece around toward its cylindrical configuration. The die 132 at the tenth stage has a concave surface 133 which approaches a semicylindrical shape. However, it is flattened at its intermediate side portions 134 and 135. Above the die surface 133 is a punch 136 in the form of a stud carried by a vertical flange 137, again having threads which match those of the end portion of the workpiece. The sides 138 and 139 of the stud 136 are flattened to permit the stud to leave the workpiece on the upward stroke. As for the studs 115 and 116, the thread contour is carried around to the flat surfaces 138 and 139 to assure clearance and absence of damage to the threads during the shaping of the workpiece.

When the punch 136 hits the workpiece it drives the end part 59 into the die opening 133, causing it to assume the shape of the die opening. The flattened intermediate side portions 134 and 135 give the die opening a taper that helps center the end part 59 of the workpiece in the die opening. At this stage, the single stud 136 engages the central part 100 of the workpiece and cooperates with the die opening to reverse the curvature in this area from convex to concave. Upon completion of the tenth stage, the opposite edges 140 and 141 of the end part 59 of the workpiece remain spaced apart, but have been moved closer together because of the increased curvature given the workpiece, so that there is a narrow gap between them.

A die 142 inwardly of the die 132 at the tenth stage has a concave surface 143 that receives the connecting strips 127 and 128 of the workpiece and is similar to the die 129.

Between the ninth and tenth stages, a pilot 144 fits between the connecting strips 127 and 128 of adjacent sections of the workpiece, entering an opening 145 between dies 129 and 142. This is for indexing of the workpiece in this area.

Figure 28:
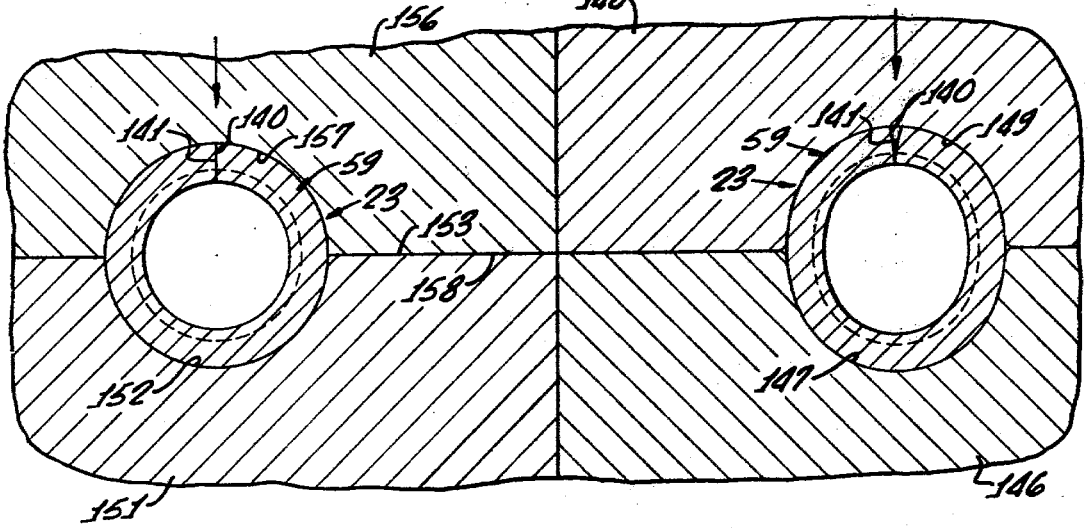
FIG. 28 is an enlarged fragmentary sectional view showing the punch and die engaging the workpiece at the eleventh and twelfth stages, with the punch at the bottom of its stroke.

At the eleventh die stage, outer part 59 of the workpiece is formed into a sleeve, which approximates but does not achieve the cylindrical configuration of the sleeve portion 11 of the completed part. The die 146 at the eleventh stage has a concave surface 147 with rounded convex corners. The punch 148 is similar, having a recess 149 of the same shape. At the eleventh stage, therefore, the opposite edges 140 and 141 of the outer part 59 of the workpiece, which are at the central portion of the punch cavity 149, are brought together to produce a sleeve. The end part 59 has approached a cylindrical configuration sufficiently prior to the eleventh stage to enable the die surfaces 147 and 149 to push inwardly on the workpiece toward its axis as the workpiece is forced into the die openings. The engagement with the outer part 59 of the workpiece is only on its exterior, i.e., the side opposite the thread grooves 79, with no mandrel entering the sleeve. The surfaces 147 and 149 together define a closed curve shaped so as to give the workpiece a somewhat elliptical contour, as seen in FIG. 28, with the major axis extending vertically. The width of the elliptical section (i.e., the horizontal dimension normal to the direction of movement of the punch) is equal to or slightly less than the outside diameter of the sleeve 11 of the completed part 10.

A die 150 is inward of the die 146 at the eleventh stage, recessed for the connecting strips 127 and 128 of the workpiece similarly to the die 142.

Figure 27:
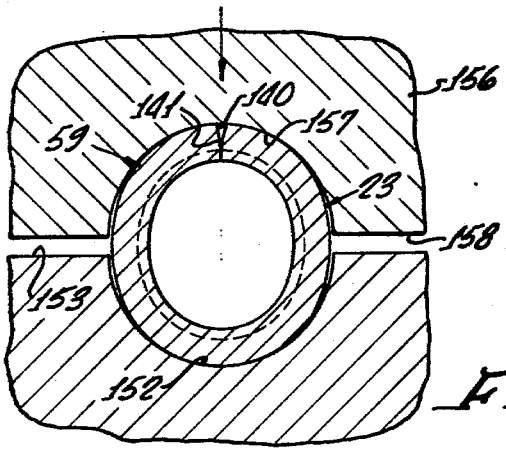
FIG. 27 is an enlarged fragmentary sectional view showing the punch and die engaging the workpiece at the twelfth forming stage, with the punch just short of the bottom end of its stroke.

The die 151 at the twelfth forming stage includes a semicylindrical concave surface 152, having the same curvature as the sleeve portion 11 of the completed part 10, which intersects a flat upper die surface 153. The punch 156 of the twelfth stage has a semicylindrical surface 157 corresponding to the die surface 152, also being complementary to the sleeve portion 11 of the completed part 10. The edges of the surface 157 extend to a flat horizontal bottom surface 158 of the punch. When the workpiece section 59 is engaged by the die surfaces 152 and 157, as seen in FIG. 28, it is not only given a regular cylindrical contour, but also the opposite edges 140 and 141 of this section are forced tightly together, with no gap remaining. The fact that the workpiece is no wider than the surfaces 152 and 157 when it enters the twelfth stage assures that it does not become pinched between the horizontal surfaces 153 and 158 of the die and punch. This can be seen in FIG. 27 where the punch and die are about to close over the oval-shaped workpiece. A clearance exists at the sides of the workpiece even though the upper extremity of the workpiece at the edges 140 and 141 is engaged by the center of the punch cavity 157 and the lower extremity, opposite from the edges 140 and 141, is engaged by the center of the die cavity 152. If the workpiece were wider than the diameter of the surfaces 152 and 157, some portion of its exterior would be forced outwardly between the surfaces 153 and 158 and a flashing would be produced on the workpiece when the punch and die were brought together.

In order to assure complete compliance with the die openings 152 and 157, without a mandrel inside the sleeve, the workpiece end portion 59 is compressed as it is formed in the twelfth stage. This compression causes the material to be forced outwardly to engage the surfaces 152 and 157 throughout its periphery, irrespective of the deviations from a cylindrical form present as it enters the twelfth stage. This compression is accomplished by making the end portion 59 longer than the circumference required for the completed sleeve portion 11. For example, in a part 0.074 inch thick, with the average of the inside and outside circumference of the sleeve being 1.285 inches, the end portion 59 is given a dimension of 1.335 inches between its edges 140 and 141, so that it is oversize by 0.050 inch. The result is a compression of the workpiece at the twelfth stage as the portion 59 is forced to comply with die surfaces of lesser circumference than it possesses. With the portion 59 of the workpiece being rounded as a sleeve, the compressive forces deflect the outer surface of the workpiece outwardly into intimate contact with the die surfaces. This also causes the edges 140 and 141 to be brought tightly together so that an accurate gap-free seam is produced. This accurate forming to a cylindrical shape by compressing the workpiece and without the use of a mandrel is useful in producing tubular parts even where they are unthreaded.

There is no need for compression of the workpiece at the eleventh stage, however, so the die and punch openings 147 and 149 have a combined perimeter as great as the workpiece dimension.

The grooves 79 in the outer portion 59 of the workpiece are at an angle relative to the axis of the completed sleeve such that a continuous thread is produced when the edges 140 and 141 are brought together. This means that the end of one groove 79 precisely aligns with the end of the next adjacent groove 79 at the opposite edge, as seen in FIG. 30. The result is an uninterrupted helical thread.

Inwardly of the die 151 is a die 161 which is similar to the dies 129, 142, and 148, being recessed to receive the projecting strips 127 and 128 of the workpiece 23.

During the forming at the tenth, eleventh, and twelfth stages, pilots 163, 164, and 165 extend into die openings 166, 167, and 168, when the press is moved to the bottom of its stroke. These pilots, therefore, fit between the projecting strips 127 and 128 of adjacent sections of the workpiece, assisting in positioning the workpiece as the forming takes place.

At the thirteenth stage (FIG. 9) the projecting strips 127 and 128 are bent to provide half of the curvature of the U-shaped retainer portions 12 and 13 of the completed part 10. To this end, the die 170 at the thirteenth stage includes a flat upper surface 171 and a vertical forward surface 172 connected to the upper surface by an arcuate corner portion 173.

Spaced forwardly of the die 170 is a die 174 with a semicylindrical recess 175 for receiving the outer end portion 59 of the workpiece.

The punch includes a forward portion 177 with a semicylindrical surface 178 to engage the upper side of the outer end portion 59 of the workpiece. On the rearward vertical face of the forward punch section 177 is a flat plate 179 which has a lower edge 180 at the same level as the bottom surface 181 of the punch section 177. The inner face 182 (FIG. 17) of the plate 179 is spaced forwardly of the forward wall 172 of the die 170 by a distance equal to the thickness of the material of the workpiece 23.

Figure 17:
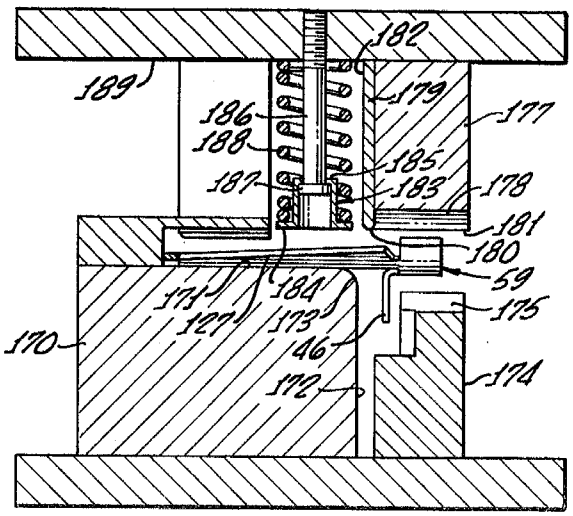
FIGS. 15, 16, 17, and 18 are transverse sectional views taken along line 15—15, 16—16, 17—17, and 18—18 of FIG. 12, respectively, illustrating the forming of the workpiece at the second, sixth, thirteenth, and fourteenth stages.

Inwardly of the punch member 179 is a pressure pad 183 which is a cup-shaped element having a flat bottom horizontal flange 184 (see FIGS. 9 and 17). An opening in its upper wall 185 receives the shank of a stud 186 which has a head 187 inside the member 183 to limit its downward travel. A compression spring 188 bears against the upper punch wall 189 at its upper end and at its lower end engages the flange 184 of the pressure pad 183. This biases the pressure pad 183 to a normal position in which its upper wall 185 engages the head 187 of the stud 186.

When the press is moved to the bottom of its stroke, the bottom edge 180 of the plate 179 engages the projecting strips 127 and 128 of the workpiece just beyond the end portion 59 of the workpiece. Continued downward movement of the press causes the plate 179 to wrap the projecting strips 127 and 128 around the arcuate die surface 173, forcing them against the vertical die surface 172 of the die 170. As the plate contacts the strips 127 and 128, they are also engaged by the bottom flange 184 of the pressure pad 183. This flattens the strips 127 and 128 beyond the portions being bent around the die 170, holding them against the horizontal upper die surface 171 to resist the outward pull caused by the forming. The spring loaded nature of the pressure pad 183 means that it can engage the strips 127 and 128 to hold them throughout the time they are bent around the die 170, with the spring 188 yielding as the punch moves to the bottom of its stroke.

Also during this forming of the workpiece, the outer portion 59 of the workpiece is held between the surface 175 of the die 174 and the surface 178 of the punch 177. This maintains the end portion 59 in a horizontal attitude, irrespective of the bending of the projecting strips 127 and 128.

Figure 18:
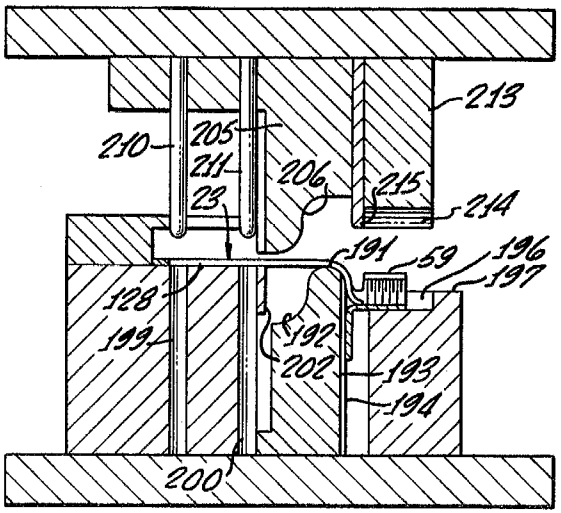

At the fourteenth stage, the workpiece receives its final forming and the completed part 10 is separated. The workpiece is bent around a die 190, which has a convex upper surface 191 of semicylindrical configuration, as seen in FIGS. 9 and 18. The radius of curvature of the die surface 191 is the same as that of the surface 173 of the die 174. A concave surface 192 is tangent to the surface 191 at its inner lower edge and has the contour of a segment of the cylinder. On the forward side of the die 190 is a vertical recess 193 in the forward vertical wall 194. This recess provides clearance for the prong 46, when the workpiece is formed on the die 190.

A die 195 is spaced forwardly of the die 190, being provided with a semicylindrical recess 196 in its upper surface 197.

To the rear of the die 190 is an additional die 198 through which extends spaced vertical cylindrical openings 199 and 200. The die 198 has a flat upper surface 201 and a forward upper vertical wall section 202 which is above the lower extremity of the concave die surface 192 of the die 190. Two spaced semicylindrical vertical grooves 203 and 204 are formed in the die surface 202.

Above the die assembly at the fourteenth stage is a punch 205, having a lower surface 206 generally complementary to the rearward upper portion of the die 190. In other words, the punch surface 206 corresponds to the rearward half of the convex die surface 191 as well as the concave die surface 192. On the flat rearward vertical face 207 of the punch 205 are two semicylindrical ridges 208 and 209 which correspond in contour and position to the grooves 203 and 204.

Also carried by the punch are vertical pins 210 and 211 which are above the die openings 199 and 200 so that they will enter these openings on the downward stroke of the press.

The forward punch 213 has a bottom recess defined by a semicylindrical surface 214 at the rearward edge of which is a wall 215 which partially closes out the end of the surface 214.

Between the thirteenth and fourteenth stages, a pilot 216 enters a die opening 217, fitting between adjacent sections of the workpiece to assist in positioning the workpiece.

When the workpiece 23 is indexed at the fourteenth stage, the projecting strips 127 and 128 extend directly over the vertical grooves 203 and 204. Consequently, when the press moves downwardly the strips 127 and 128 are engaged by the ridges 208 and 209. This severs the strips 127 and 128, shearing them at the corners of the grooves 203 and 204, where these grooves meet the flat upper die surface 201. As this occurs, the vertical pins 210 and 211 act as pilots to maintain the spacing of the strips 127 and 128 and assure that they are not pulled toward each other and out of alignment with the grooves 203 and 204, and ridges 208 and 209.

Continued downward movement of the punch causes the surface 206 to force the severed strips 127 and 128 into engagement with the rearward part of the die surface 191 and the lower concave die surface 192. This contours the strips 127 and 128 into the U-shaped receptacle portions 12 and 13 of the completed part, the reversely bent end portions 14 and 15 being bent along the surface 192.

As this forming takes place, the outer portion 59 of the workpiece is held between the punch surface 214 and the die surface 196 and restrained against longitudinal movement by the element 215. This completes the formation of the part 10.

The threads of the part 10 may be made self-locking so that they will provide tight engagement at any rotational position and will not be loosened by vibration or other service conditions. This is accomplished by making the thread grooves 79 more shallow at the inner end of the threaded section than at the outer end where the mating threaded part, such as the stud 20, enters. The ridges on the punches 56, 57, and 58 are made less deep at the portions of these punches that strike the workpiece inwardly of the edge 35 than are the ridges adjacent the edge 35 to produce this relationship of the thread grooves. The entrance threads of full depth allow the mating of the threads to start without difficulty. The inner threads of less depth cause the sleeve portion 11 to grip the stud, exerting a compressive force on its exterior so that friction resists relative rotation. The fact that the sleeve 11 is longitudinally split, where the edges 140 and 141 are brought together, enables it to grip the stud in this manner without causing the threads to bind. The stud, entering the tapered threads, can tend to spring the sleeve edges 140 and 141 very slightly apart to produce a resilient, but yielding, gripping force.

The hanger 10 in the foregoing example is intended for use primarily with studs 20 which ordinarily are provided with rolled threads. These threads, in most instances, are somewhat undersize for which reason the threads for the sleeve 11 of the part are made relatively shallow. Other threaded members may have a deeper thread, parts with commercial threads in many instances having threads made to 75% of the standard depth. There is no difficulty in threading parts made in accordance with this invention deeper than in the example given, to be compatible with mating parts with deeper threads. This is accomplished by adjusting the punches 56, 57, and 58 downwardly, or mating the groove-forming ridges thereof more downwardly protuberant, so that the bottom ends of their strokes are lower. In order to obtain 75% of standard thread depth, these punches may be set or constructed to sink the grooves 79 to a depth of 0.016 inch at the fourth stage, 0.022 inch at the fifth, and 0.027 inch at the sixth stage.

A minor increase in thread depth, about 0.003 inch, is realized from the engagement of the workpiece 23 by the studs at the seventh, eighth, ninth, and tenth stages, as the part is being bent. In other words, the studs 95 and 96 at the seventh stage, 107 and 108 at the eighth stage, 115 and 116 at the ninth stage, and 136 at the tenth stage engage successively nearly the entire surface of the end portion 59 of the workpiece, and, in the course of bending the workpiece, also deepen the grooves as a result of the impact. These studs are of full standard thread depth so that they can readily accomplish the deepening of the grooves in the workpiece. In the example shown in the drawing, this increases the depth of the grooves from 0.019 inch to approximately 0.022 inch. Where a 75% depth thread is desired, the studs at the seventh, eighth, and ninth stages deepen the grooves 79 to approximately 0.030 inch.

The deeper thread of 75% depth will be looser on an undersize stud and may not provide a self-locking effect when used on a stud of the rolled thread type.

Embodiment of FIGS. 31 through 36

For certain parts, such as in producing a threaded sleeve with no other components attached to it, the sheet-metal workpiece is caused to expand in two directions as the grooves for the thread are formed. Such two directions are both in the plane of the workpiece, and are opposite to each other and substantially perpendicular to the grooves. There is nothing comparable to the pilots 61, 68 and 70 of the fourth, fifth and sixth stages of the above example. With the two opposite edges unrestrained, the workpiece will expand bidirectionally outwardly under the impacts of the punches.

Figure 21:
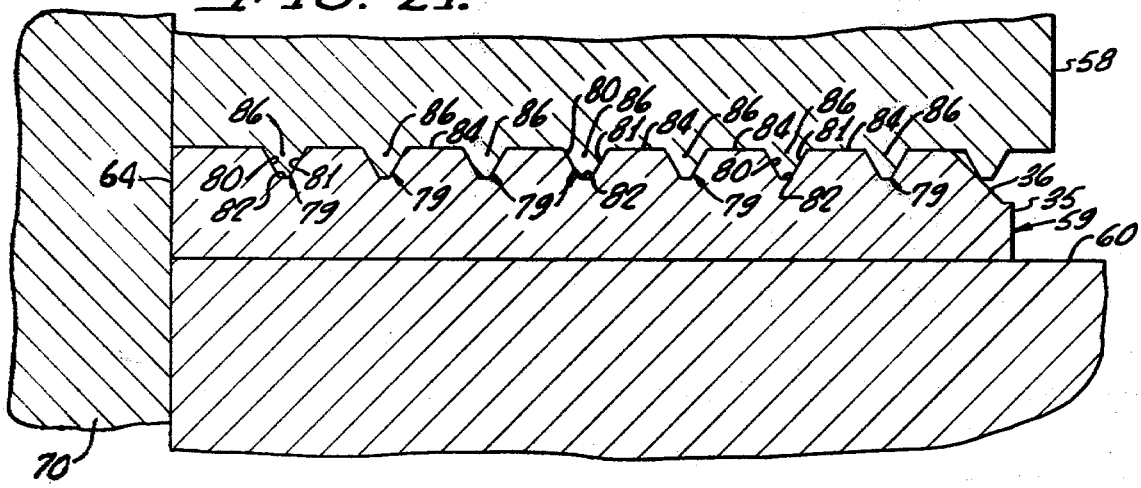
Figure 31:
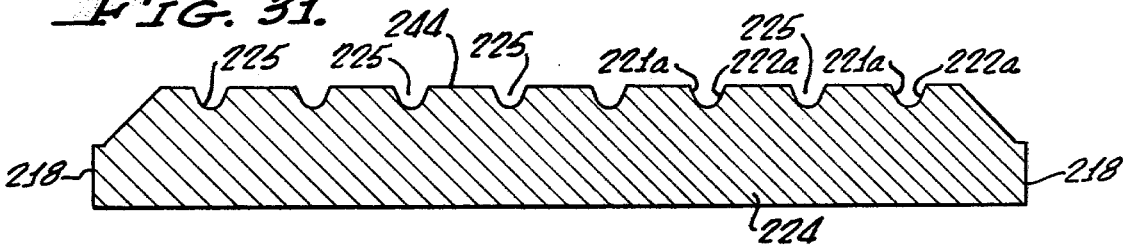
FIGS. 31, 32 and 33 are enlarged fragmentary sectional views, illustrating the grooves for the thread in a second embodiment of the invention wherein the workpiece is not restrained on either side but instead is caused to grow in opposite directions transversely of the grooves.
Figure 33:
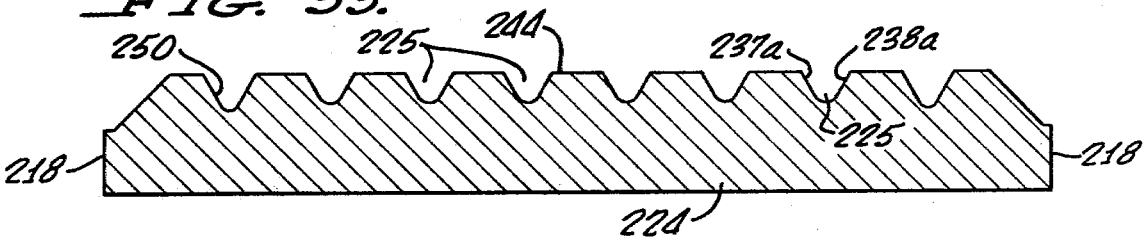
Figure 34:
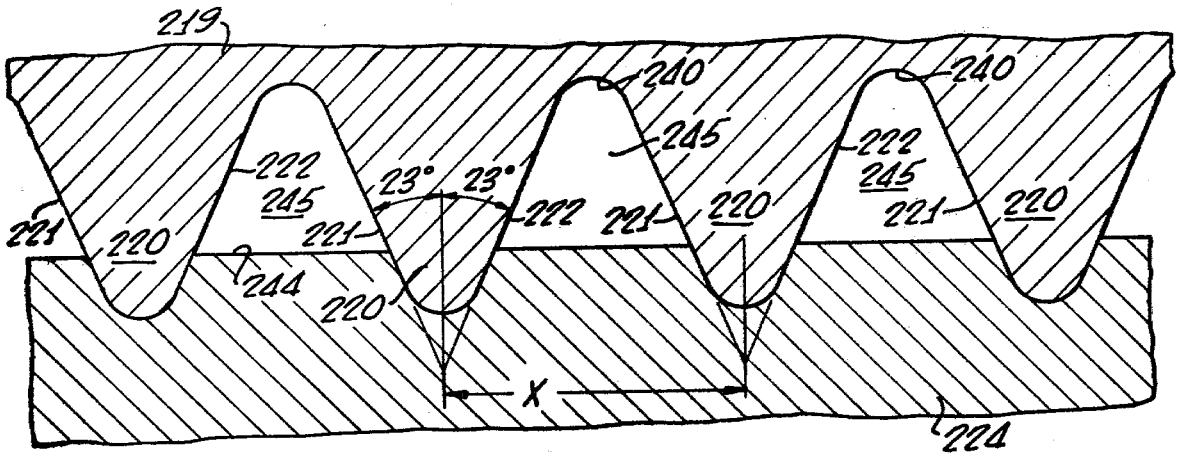
FIGS. 34, 35 and 36 are further enlarged fragmentary sectional views showing the punches in the grooves of the second embodiment.

FIGS. 31 and 34 correspond to each other and may be considered in conjunction with FIGS. 19 and 22 of the previous embodiment, in that the first thread-forming stage is shown. Similarly, FIGS. 32 and 35 correspond to each other and may be considered in conjunction with FIGS. 20 and 23, whereas FIGS. 33 and 36 correspond to each other and may be considered in conjunction with FIGS. 21 and 24.

Figure 32:
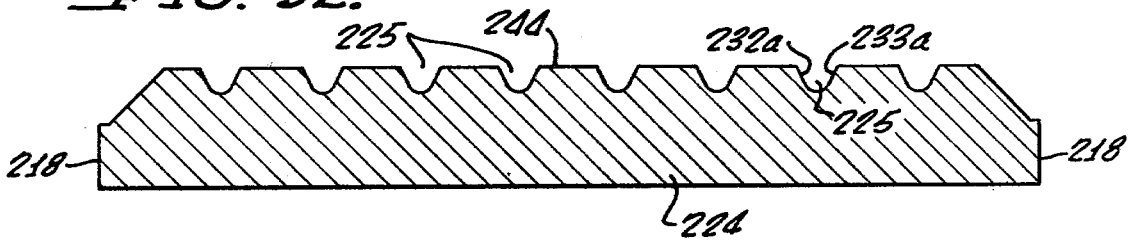
Figure 35:
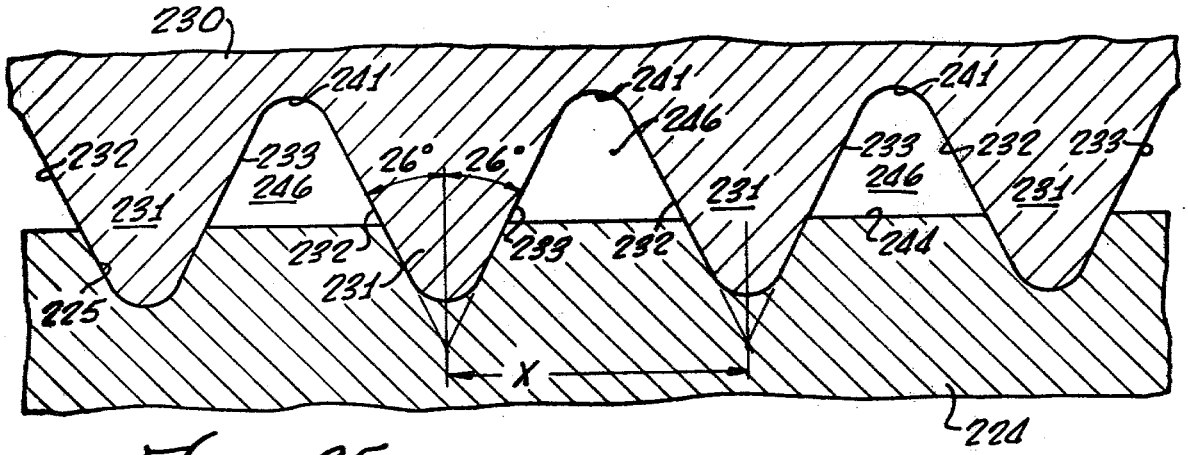

To shift the workpiece from the stage of FIGS. 31, 34 to that of FIGS. 32, 35 and then 33, 36, suitable guide and actuating means, not shown, are provided. These may correspond generally to what has been described in detail relative to the previous embodiment, except that the guide means are such that the strip material is allowed to grow in both directions instead of only one. In other words, both of the opposite edges 218 are allowed to expand outwardly. Referring to FIGS. 31–33, it is pointed out that the material in FIG. 32 is somewhat wider than that in FIG. 31, and that that in FIG. 33 is wider yet. However, the grooves shown in such figures are in the same positions; the grooves remain fixed.

In the present embodiment, wherein workpiece growth occurs in both directions lateral to the grooves, the flank or wall angles of the grooves are substantially the same in each stage, so each groove is substantially symmetrical in all stages (as distinguished from the previous embodiment wherein each groove was asymmetrical in the first two groove-forming stages). In the first stage (FIGS. 31, 34) the flank angles are relatively steep and the punch ridges penetrate to a depth far less than the depth of the groove bottoms in the finished part. In the second stage (FIGS. 32, 35) the groove walls are less steep but are still more inclined than are the walls of the desired finished grooves. In the third stage (FIGS. 33, 36) the grooves are further widened to achieve the exemplary 30° flank inclination of the finished grooves. As was the case relative to the previous embodiment, the punch ridges in the second stage penetrate more deeply into the workpiece than is the case relative to the first stage, and the punch ridges in the third stage penetrate somewhat more deeply still.

Referring to FIG. 34 in particular, the punch 219 of the first stage has on the lower side thereof a series of parallel ridges 220 which are spaced laterally apart a distance corresponding to the pitch of the thread to be produced. Such pitch is represented, for example, by the letter "X" in FIGS. 34–36. It is the same relative to all grooves in all stages, except in certain unusual cases (for example, when one groove is to have a somewhat different pitch in order to achieve a different type of frictional locking action than that described above).

On one side of each ridge 220 of punch 219 is a flank 221, while on the other side of each ridge is a flank 222. Such flanks are relatively steeply inclined and at substantially the same angles, the flanks converging downwardly as shown. Each flank angle is far steeper than that of the flanks in the desired finished thread.

When punch 219 strikes the metal workpiece 224, which is supported as in the previous embodiment, it forms a set of equally spaced parallel grooves 225 having shapes and flank angles corresponding to those of the lower portions of punch ridges 220. It is to be understood that FIGS. 34–36 show the respective punches in their lowermost positions relative to the workpiece.

Referring to the next die stage, FIGS. 32 and 35, the illustrated punch 230 has parallel ridges 231 which are spaced correspondingly to ridges 220 and are adapted to register with and be inserted into the grooves 225, such grooves being only partially formed during the first stage. As shown in FIG. 35, the flanks or sidewalls of ridges 231 are less steeply inclined than are the flanks 221, 222 but are still more steeply inclined than are the flanks of the desired completed thread. One set of flanks of ridges 231 is numbered 232, whereas the opposite set is numbered 233. As in the first stage, flanks 232, 233 are downwardly convergent, and each is at substantially the same inclination as the other (being on opposite sides of the central plane of each ridge 231). After punch 230 strikes workpiece 224, the above-indicated grooves 225 are deepened and widened and their cross-sectional shapes are changed. The sidewalls of the grooves are mirror images of each other, and have the inclinations and shapes of the lower portions of punch ridges 231.

Figure 36:
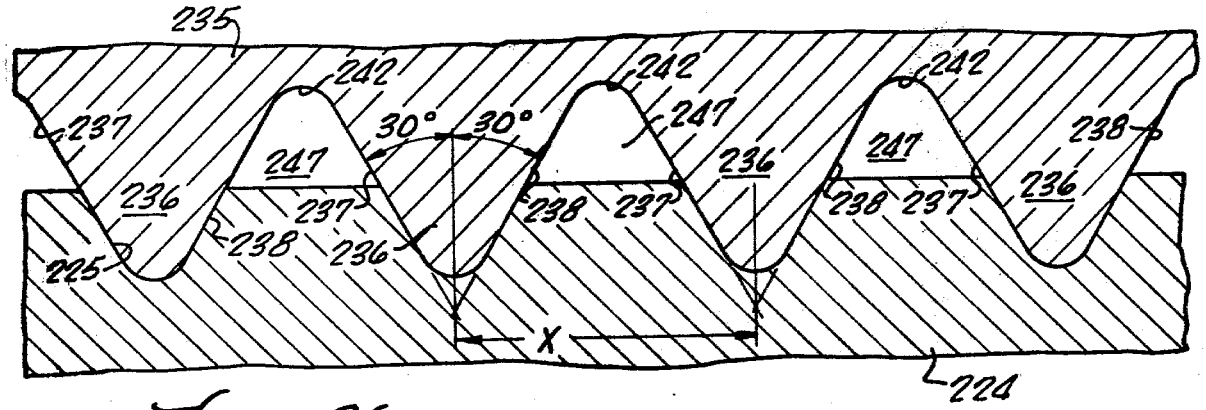

Referring next to the third forming stage of the grooves, as shown in FIGS. 33 and 36, there is some further penetration and, additionally, the groove walls are given substantially their final inclinations, for example 30° in the present illustration. Thus, there is produced by punch 235 and its ridges 236 the exemplary 30° angle for the sidewalls of the grooves 225. One set of flanks of punch ridges 236 is numbered 237 in FIG. 36, whereas the other set is numbered 238.

In FIG. 31, the groove walls which are made by ridge flanks 221 and 222 (FIG. 34) are numbered, respectively, **221*a* and 222*a*. In FIG. 32, the groove walls 232*a* and 233*a* are those made by ridge flanks 232 and 233, respectively, whereas in FIG. 33 the groove walls 237*a* and 238*a* are those made by the ridge flanks 237 and 238. The ridge flank angles (thus groove angles) shown in FIGS. 34–36 are specific examples and may vary somewhat in accordance with factors including the type of workpiece metal, the thickness of the sheet stock, etc. In FIG. 34, each flank 221, 222 is shown as being at an angle of about 23° relative to a line perpendicular to the upper surface of workpiece 224. The corresponding angles in FIGS. 35 and 36** are about 26° and 30°.

Figure 24:
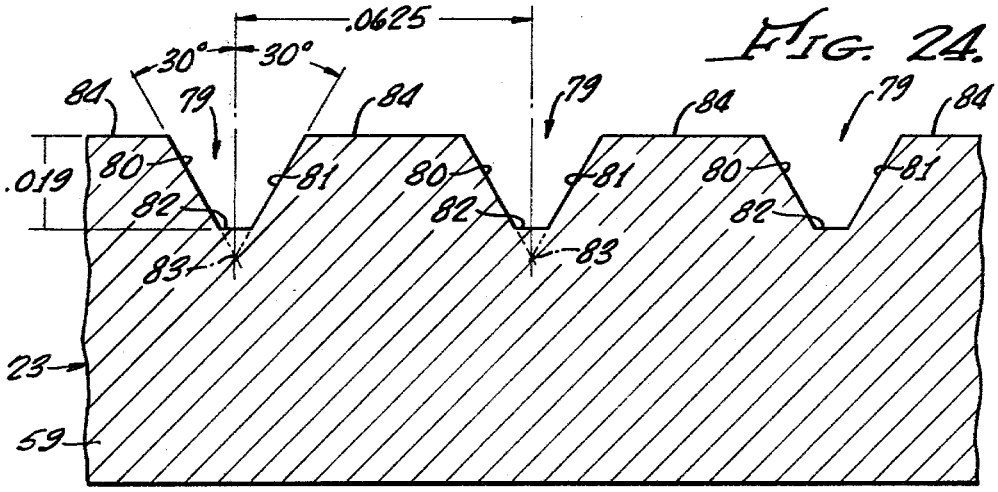

As illustrated in FIGS. 34–36, there are no sharp corners where the flanks of the ridges on the punches at the various forming stages connect to the bottom surfaces of the ridges. Instead, each ridge has a rounded contour. The "corner" of the bottom of each ridge typically has a radius of about 0.010 inch, the rounded corner surfaces being made tangent to the flanks. The stated radius is exemplary only and will vary in accordance with factors including the size and diameter of the threaded parts, the above-mentioned radius being typical for a part wherein the pitch (X in FIGS. 34–36) is 0.625 inch as shown in FIGS. 22–24.

The stated rounded shape helps the ridges penetrate the workpiece so as to cause the metal of the workpiece to flow better during the different forming stages, whereas sharp corners have more tendency to dig into the workpiece metal. Accordingly, the rounded corners are preferred in producing a well-defined thread.

Intermediate the ridges of each punch 219, 230 and 235 are upwardly concave rounded surfaces 240, 241 and 242, respectively. These surfaces are tangent to the flanks of the respective ridges. Such rounded surfaces avoid stress concentrations in the punches, and lessen any danger of breakage of the punches as they strike the workpiece.

At the bottom of the press stroke, surfaces 240, 241 and 242 remain spaced well above the upper surface 244 of workpiece 224. Stated otherwise, there are chambers or passages 245, 246 and 247 defined above the regions of upper surface 244 between the punch ridges, which chambers or passages contain air and not metal. Such spacing, namely the maintaining of these chambers 245–247, avoids creating locks from excessive material between the ridges of the punches, which locks might occur from variation in thickness of the workpiece or from foreign matter on the upper surface 244 thereof. If a lock is created, for example from such excess material, a punch may be broken. Therefore, to insure a trouble-free production run, the punches should be dimensioned so as to provide the indicated spaces, passages or chambers. This is the preferred form, and should be employed not only relative to the embodiment of FIGS. 31–36, inclusive, but also relative to the thread-forming aspects of the previous embodiment.

Referring next to the left side of FIG. 33, it is to be noted that one groove 250 is shown deeper than are the intermediate grooves 225 in the finished workpiece 224. Another deep groove is shown at the right side. Such groove is achieved by causing the associated punch ridges to be somewhat more downwardly protuberant than are those shown relative to FIGS. 34–36. The relatively deep grooves 250 (which may, if desired, be continued for more than one revolution of the finished thread) are adapted to facilitate initial insertion of a stud or bolt such as stud 20 shown in FIG. 2, this being in embodiments where high-friction locking action is desired.

It is to be understood that the part produced by the method as described relative to FIGS. 31–36 is subsequently formed into cylindrical shape as described relative to stages 7–12 of the previous embodiment. The result is a finished part having a longitudinal section similar to that of FIG. 30 except that the roots of the illustrated thread are somewhat rounded.

The thread grooves formed by the embodiment of FIGS. 31–36 may be made deeper, closer together, etc., than what are shown in the drawings (this being also true relative to the first embodiment, as described above).

For some (relatively few) types of parts a customer may desire that the adjacent edges of the cylindrically-bent sheet metal not touch each other, but instead that a gap be left therebetween. When a gap is present the advantage of forcing the workpiece outwardly by compression to engage the walls of the dies, as described above, is lost. However, where the workpiece is relatively thick it more nearly assumes a true cylindrical shape, irrespective of whether or not its edges 140 and 141 are brought into abutment, than is the case for thinner workpieces.

It is to be understood that for some parts the direction of progression through the press may be substantially perpendicular to the threads, instead of substantially parallel thereto as in the illustrated embodiments.

Both embodiments, namely that of FIGS. 1 through 30 and that of FIGS. 31 through 36, have been described in detail as incorporating three thread-forming stages. Under some conditions, such as (for example) with certain metals which are relatively thin, the number of stages may be reduced to two. Also, two stages may be employed where someone does not desire such a perfect thread as that resulting from the method described in detail above. In the great majority of cases, it is preferred that there be three stages.

Throughout this specification and claims, the words "steep" and "shallow", in reference to flank or sidewall angles of the threads, are for convenience based on a horizontal reference plane since the motion in a conventional punch press is vertical and the workpiece in such a press is conventionally horizontal. Thus, for example, a thread flank of a horizontal workpiece, which flank is inclined at 17° from the vertical, is "steeply" inclined, whereas a flank inclined at 30° from the vertical has a relatively "shallow" inclination.

The words "cylindrical and "cylinder" are, of course, used in the present specification and claims in their conventional senses, as shown in the drawings, to denote a surface of revolution traced by a straight line moving parallel to a fixed straight line and intersecting a fixed circle, such circle having its center at the fixed straight line and lying in a plane perpendicular thereto. The terms "substantially cylindrical" and "generally cylindrical" are intended to include contours that experience minor deviations from a true cylindrical shape, including a slight taper as in a frustum of a cone, and to describe parts where a gap exists between the adjacent edges of the threaded section.

The foregoing detailed description is to be clearly understood as given by way of illustration and example only, the spirit and scope of this invention being limited solely by the appended claims.

We claim:

1. The method of forming a part having a screw thread having flanks at a predetermined angle comprising the steps of engaging one side of a workpiece with means having ridges thereon so as to provide a plurality of substantially parallel grooves in said one side of said workpiece extending from adjacent a first edge of said workpiece to adjacent a second edge of said workpiece opposite from said first edge, said engagement first being by at least one member in which said ridges have at least some sidewalls which are more steeply inclined than the flanks of said screw thread so as to produce grooves in said one side of said workpiece having correspondingly inclined sidewalls, and then by another member having ridges thereon having sidewalls which are more shallowly inclined than are said sidewalls of said ridges of said one member and which conform substantially to the angle of the flanks of said screw thread so as to cause said grooves to have sidewalls corresponding in inclination to the flanks of said screw thread, and then bringing said first and second edges into proximate relationship relative to each other to impart a substantially cylindrical configuration to said workpiece with the ends of adjacent ones of said grooves being positioned substantially in alignment with each other at said first and second edges to define a helix and produce a screw thread on said workpiece.

2. The method as recited in claim 1 in which said workpiece is provided with a third edge interconnecting said first edge and said second edge, and including the step of providing a bevel on said third edge so that said grooves are inwardly of said third edge and said screw thread is recessed relative to said third edge.

3. The method as recited in claim 2 in which for providing said bevel said workpiece is made initially to extend beyond said third edge, then said workpiece is engaged at the location of said third edge by means having an inclined wall so as to provide a groove having an inclined wall in said workpiece at the location of said third edge, and then said workpiece is cut so as to remove the portion thereof beyond said groove at said third edge with said inclined wall of said groove at said third edge providing said bevel.

4. The method as recited in claim 3 in which said means having an inclined wall is provided with a substantially flat surface adjoining said inclined wall and provides said groove at said third edge with a substantially flat bottom wall, and in which when said workpiece is cut at said groove at said third edge it is cut along the location of said substantially flat bottom wall so that said bevel is remote from the location of said cut.

5. The method of forming a part having a screw thread having a predetermined contour comprising the steps of engaging one side of a workpiece with a means having ridges thereon so as to provide a plurality of substantially parallel grooves in said one side of said workpiece extending from adjacent a first edge of said workpiece to adjacent a second edge of said workpiece opposite from said first edge, with said grooves being made more shallow and narrower than said screw thread, then engaging said one side again with a means having ridges thereon so as to deepen and widen said grooves to achieve substantially said predetermined contour of said thread, and then bending said workpiece to impart a substantially cylindrical configuration thereto, with the ends of adjacent ones of said grooves being positioned substantially in alignment with each other at said first and second edges to define a helix and produce a screw thread for said workpiece.

6. The method as recited in claim 5 in which said workpiece is so engaged by impact by moving members rectilinearly relatively toward said one side of said workpiece.

7. The method as recited in claim 5 in which said workpiece is provided with a third edge interconnecting said first and second edges, and at least one of said grooves when said grooves have so achieved said predetermined contour is made deeper adjacent said third edge than are said grooves remote from said third edge for providing a relatively loose thread for said threaded part adjacent said third edge, and relatively tight threads for resisting rotation at said location remote from said third edge.

8. The method as recited in claim 5 in which for so bending said workpiece into a substantially cylindrical shape said workpiece is positioned so that the opposite side thereof is adjacent a first means having a first cavity therein, said first cavity being provided with a duality of spaced concave surfaces and a convex surface intermediate said concave surfaces, engaging said one side of said workpiece by a duality of convexly arcuate first members having ridges thereon corresponding to said grooves in said one side of said workpiece and forcing said workpiece thereby into said first cavity to assume substantially the contour thereof, then positioning said workpiece adjacent a second means having a second cavity therein, said second cavity being provided with a duality of spaced concave surfaces and a convex surface intermediate said concave surfaces of said second cavity, said concave surfaces of said second cavity being positioned closer together than said concave surfaces of said first cavity, engaging said one side of said workpiece by a duality of spaced convexly arcuate second members which are closer together than are said first members and forcing said workpiece into said second cavity for assuming substantially the contour thereof, then positioning said workpiece adjacent a third means having a third cavity therein, said third cavity being provided with a concave surface, engaging said one side of said workpiece by a third convexly arcuate member and forcing said workpiece into said third cavity for substantially assuming the contour thereof, and then engaging said opposite side of said workpiece and forcing said opposite edges into adjacency.

9. The method as recited in claim 8 in which for so engaging said opposite side of said workpiece for bringing said opposite edges into adjacency, said workpiece is engaged by opposed means, each of which has a cavity therein.

10. The method as recited in claim 5 in which for so bending said workpiece into a substantially cylindrical shape said workpiece is engaged on the opposite side thereof by a first means having a cavity of predetermined contour therein, and is engaged on said one side by a second means for forcing said workpiece into said cavity for assuming the contour thereof, said second means being provided with ridges thereon complementary to said grooves on said one side of said workpiece, whereby said second means when so engaging said workpiece does not distort said grooves on said one side of said workpiece, and then said workpiece is engaged on said opposite side for bringing said opposite edges thereof into adjacency.

11. The method as recited in claim 10 in which at least one cylindrical threaded shank is used for said second means.

12. The method as recited in claim 10 in which said second means includes two spaced parallel elements, each of which is so provided with said ridges complementary to said grooves on said one side of said workpiece.

13. The method as recited in claim 12 in which said cavity in said first means is provided with two concave portions opposite from said two spaced parallel elements, and a convex portion between said concave portions, and in which said first means is provided with a second cavity therein having a concave surface having greater curvature than that of said first-mentioned cavity, said second means is provided with a member opposite said concave surface of said second cavity, said workpiece being engaged by said member of said second means and forced into said second cavity to substantially assume the contour thereof subsequent to said engagement by said two elements for forcing said workpiece into said first-mentioned cavity.

14. The method as recited in claim 13 in which said member of said second means is provided with an arcuate surface opposite said second cavity and relatively flatter surfaces alongside said arcuate surface for providing clearance between said opposite edges of said workpiece for said member of said second means when said member of said second means is withdrawn from said workpiece.

15. The method as recited in claim 13 in which said ridges on said member of said second means are extended from said arcuate surface onto said relatively flatter surfaces for avoiding distortion of said grooves in said workpiece when said workpiece is forced into said second cavity by said member of said second means.

16. The method of forming a threaded part comprising the steps of forming in one side of a workpiece a plurality of parallel grooves extending from adjacent a first edge of said workpiece to adjacent a second edge of said workpiece opposite from said first edge, with said grooves being given a cross section corresponding substantially to the cross sectional configuration of a screw thread, and being spaced apart a distance corresponding to the pitch of said screw thread, then engaging said one side of said workpiece by means having ridges thereon corresponding in configuration to the configuration of said screw thread and forcing said workpiece on the opposite side thereof into a recess in a die so as to impart a curvature to said workpiece while substantially preserving the shape of said grooves, and then, while making no engagement with said one side of said workpiece, engaging said opposite side and bringing said first and second edges into adjacency so as to impart a greater curvature and giving a substantially cylindrical configuration to said workpiece with the ends of adjacent ones of said grooves in alignment with each other at said first and second edges to define a helix and produce a screw thread on said workpiece.

17. The method as recited in claim 16 in which said means having ridges thereon is engaged with less than the full surface of said one side of said workpiece.

18. The method as recited in claim 16 in which for forming said grooves said one side of said workpiece is struck by punch means a plurality of times for progressively imparting the contour of said threads to said one side of said workpiece.

19. The method as recited in claim 18 in which in so progressively imparting the contour of said threads to said one side of said workpiece said punch means first produces grooves shallower than the depth of said threads, and then deepens said grooves to equal the depth of said threads.

20. The method as recited in claim 18 in which in so progressively imparting the contour of said threads said one side of said workpiece said punch means first produces grooves having opposed sidewalls with at least some of said sidewalls being more steeply inclined than the flanks of said thread, and said punch means then forms said sidewalls to incline at the same angle as said flanks of said threads.

21. The method as recited in claim 18 in which in so progressively imparting the contour of said threads to said one side of said workpiece said punch means first produces grooves having opposed sidewalls and a bottom wall interconnecting said sidewalls, with at least some of said sidewalls being more steeply inclined than the flanks of said threads and said bottom walls spaced beneath the outer surface of said one side of said workpiece a distance less than the depth of the root of said thread, and said punch means then imparts to said sidewalls the inclination of the flanks of said thread and depresses said bottom walls to the depth of the root of said thread.

22. The method as recited in claim 21 in which said bottom walls when first produced by said punch means are wider than they are when so depressed to the depth of the root of said thread.

23. The method as recited in claim 18 in which said workpiece is provided with third and fourth edges interconnecting said first and second edges, said third and fourth edges being made opposite from each other, and including the step of confining said workpiece at said third edge while allowing expansion of said workpiece at said fourth edge while said workpiece is struck by said punch means, and in which said punch means in so progressively imparting the contour of said threads to said one side of said workpiece first produces grooves having first and second opposed sidewalls with said first sidewalls being adjacent said fourth edge and said second sidewalls being adjacent said third edge, said punch means first imparting an inclination to said first sidewalls which is steeper than the flanks of said thread and then imparting an inclination to said first sidewalls which corresponds to the inclination of said flanks of said thread.

24. The method as recited in claim 23 in which said punch means is so progressively imparting the contour of said threads to said one side of said workpiece first imparts a slope of substantially 17° to said first sidewalls and substantially 30° to said second sidewalls relative to a line perpendicular to said one side of said workpiece, then imparts a slope of substantially 23° to said first sidewalls while retaining said second sidewalls at a slope of substantially 30° relative to said line, and then imparts a slope of substantially 30° to said first sidewalls while retaining said second sidewalls at a slope of substantially 30° relative to said line.

25. The method of forming a threaded part comprising the steps of forming in one side of a workpiece a plurality of parallel grooves extending from adjacent a first edge of said workpiece to adjacent a second edge of said workpiece opposite from said first edge, with said grooves being given a cross section corresponding substantially to the cross sectional configuration of a screw thread, and being spaced apart a distance corresponding to the pitch of said screw thread, then bending said workpiece so as to provide a curvature adjacent said first and second edges which is concave on said one side of said workpiece, and a curvature at the intermediate portion of said workpiece which is convex on said one side of said workpiece, then imparting a curvature at said intermediate portion which is concave on said one side of said workpiece, and then bringing said first and second edges into adjacency to impart a substantially cylindrical configuration to said workpiece with the ends of adjacent ones of said grooves in alignment with each other at said first and second edges to define a helix and produce a screw thread on said workpiece.

26. The method as recited in claim 25 in which all of the aforementioned steps are accomplished by engaging said workpiece on opposite sides by members relatively moving rectilinearly toward each other to provide an impact on said workpiece, and said bending of said workpiece, said imparting a curvature at said intermediate portion and said bringing said first and second edges into adjacency are accomplished without the use of a mandrel.

27. The method as recited in claim 26 in which the opposite side of said workpiece is supported on one of said members, and said one side is struck by another of said members moving rectilinearly toward said one member.

28. The method as recited in claim 25 in which for forming said grooves, the opposite side of said workpiece is positioned on a supporting surface and said one side of said workpiece is engaged by a first member so as to produce relatively shallow grooves in said one side, and then engaged by a second member so as to produce relatively deeper grooves in said one side.

29. The method as recited in claim 28 in which said workpiece is provided with third and fourth edges interconnecting said first and second edges, said third and fourth edges being opposite from each other, and in forming said grooves said third edge is restrained so as to prevent movement of material in the direction of said third edge and said fourth edge is unrestrained to permit movement of material in the direction of said fourth edge, and said grooves are provided with first walls adjacent said third edge and second walls adjacent said fourth edge with said walls diverging upwardly, and when said first member engages said workpiece said second walls are made steeper than said first walls, and when said second member engages said workpiece said second walls are given an inclination substantially the same as that of said first walls.

30. The method as recited in claim 25 in which for forming said grooves the opposite side of said workpiece is positioned on a supporting surface and said one side of said workpiece is engaged by first, second, and third members so as to produce grooves in said one side which are made progressively deeper by said first, second, and third members, said workpiece is provided with third and fourth edges interconnecting said first and second edges, said third and fourth edges being opposite from each other, said third edge is restrained when said one side of said workpiece is engaged by said first, second, and third members so as to prevent movement of material in the direction of said third edge and said fourth edge is unrestrained when said one side of said workpiece is so engaged to permit movement of material in the direction of said fourth edge, said grooves are provided with first walls adjacent said fourth edge and second walls adjacent said third edge with said walls diverging upwardly, and when said first member engages said workpiece said first walls are given a slope of approximately 17° and said second walls are given a slope of approximately 30° relative to a line perpendicular to said one side of said workpiece, when said second member engages said workpiece said first walls are given a slope of approximately 23° and said second walls are retained at a slope of approximately 30° relative to said line, and when said third member engages said workpiece said first walls are given a slope of approximately 30° and said second walls are retained at a slope of approximately 30° relative to said line.

31. The method as recited in claim 29 in which said workpiece is provided integrally with an operative element extending outwardly from said third edge.

32. The method as recited in claim 25 in which for forming said grooves, the opposite side of said workpiece is positioned on a substantially flat supporting surface, and said one side of said workpiece is struck successively by first, second, and third punch members having ridges thereon for forming said grooves, said grooves being formed progressively deeper when said workpiece is engaged by said first, second and third punch members.

33. The method as recited in claim 25 in which for providing said concave curvature adjacent said first and second edges and said convex curvature at the intermediate portion of said workpiece, said workpiece is positioned on a die having concave edge portions and a convex central portion, and said one side of said workpiece is engaged by punch elements substantially aligned with said concave sections, said punch elements having the configurations of screw threads on their lower surfaces, which configurations conform to the configurations of said grooves.

34. The method as recited in claim 29 in which said fourth edge is made substantially perpendicular to said first and second edges, and said grooves are formed at a shallow angle relative to said fourth edge for providing a helix for said screw thread when said first and second edges are so brought into adjacency.

35. A threaded part having a longitudinal split and a swaged thread which is well-formed, accurately shaped, uniform, and strong, with the flanks of its thread at a predetermined angle made by the steps of engaging one side of a workpiece with means having ridges thereon so as to provide a plurality of substantially parallel grooves in said one side of said workpiece extending from adjacent a first edge of said workpiece to adjacent a second edge of said workpiece opposite from said first edge, said engagement first being by at least one member in which said ridges have at least some sidewalls which are more steeply inclined than the flanks of said screw thread so as to produce grooves in said one side of said workpiece having correspondingly inclined sidewalls, and then by another member having ridges thereon having sidewalls which are more shallowly inclined than are said sidewalls of said ridges of said one member and which conform substantially to the angle of the flanks of said screw thread so as to cause said grooves to have sidewalls corresponding in inclination to the flanks of said screw thread, and then bringing said first and second edges into proximate relationship relative to each other to impart a substantially cylindrical configuration to said workpiece with the ends of adjacent ones of said grooves being positioned substantially in alignment with each other at said first and second edges to define a helix and produce a screw thread on said workpiece.

36. A threaded part as recited in claim 35 in which said threaded part has a bevel at one end thereof and said thread is recessed inwardly of said one end, and in which said workpiece is provided with a third edge interconnecting said first edge and said second edge, and including the step of providing a bevel on said third edge so that said grooves are inwardly of said third edge and said screw thread is recessed relative to said third edge.

37. A threaded part as recited in claim 36 in which for providing said bevel said workpiece is made initially to extend beyond said third edge, then said workpiece is engaged at the location of said third edge by means having an inclined wall so as to provide a groove having an inclined wall in said workpiece at the location of said third edge, and then said workpiece is cut so as to remove the portion thereof beyond said groove at said third edge with said inclined wall of said groove at said third edge providing said bevel.

38. A threaded part as recited in claim 37 in which said means having an inclined wall is provided with a substantially flat surface adjoining said inclined wall and provides said groove at said third edge with a substantially flat bottom wall, and in which when said workpiece is cut at said groove at said third edge it is cut along the location of said substantially flat bottom wall so that said bevel is remote from the location of said cut.

39. A threaded part having a longitudinal split and a swaged thread which is well-formed, accurately shaped, uniform, and strong, with a screw thread of a predetermined contour made by the steps of engaging one side of a workpiece with a means having ridges thereon so as to provide a plurality of substantially parallel grooves in said one side of said workpiece extending from adjacent a first edge of said workpiece to adjacent a second edge of said workpiece opposite from said first edge, with said grooves being made more shallow and narrower than said screw thread, then engaging said one side again with a means having ridges thereon so as to deepen and widen said grooves to achieve said predetermined contour of said thread, and then bending said workpiece to impart a substantially cylindrical configuration thereto, with the ends of adjacent ones of said grooves being positioned substantially in alignment with each other at said first and second edges to define a helix and produce a screw thread for said workpiece.

40. A threaded part as recited in claim 59 in which during said steps said workpiece is so engaged by impact by moving members rectilinearly relatively toward said one side of said workpiece.

41. A threaded part as recited in claim 39 in which said threaded part has a relatively loose thread at one end thereof, and in which during the steps of making said part said workpiece is provided with a third edge interconnecting said first and second edges, and at least one of said grooves when said grooves have so achieved said predetermined contour is made deeper adjacent said third edge than are said grooves remote from said third edge for providing said relatively loose thread for said threaded part adjacent said third edge, and relatively tight threads for resisting rotation at said location remote from said third edge.

42. A threaded part as recited in claim 39 in which in said step of bending said workpiece into a substantially cylindrical shape said workpiece is positioned so that the opposite side thereof is adjacent a first means having a first cavity therein, said first cavity being provided with a duality of spaced concave surfaces and a convex surface intermediate said concave surfaces, engaging said one side of said workpiece by a duality of convexly arcuate first members having ridges thereon corresponding to said grooves in said one side of said workpiece and forcing said workpiece thereby into said first cavity to assume substantially the contour thereof, then positioning said workpiece adjacent a second means having a second cavity therein, said second cavity being provided with a duality of spaced concave surfaces and a convex surface intermediate said concave surfaces of said second cavity, said concave surfaces of said second cavity being positioned closer together than said concave surfaces of said first cavity, engaging said one side of said workpiece by a duality of spaced convexly arcuate second members which are closer together than are said first members and forcing said workpiece into said second cavity for assuming substantially the contour thereof, then positioning said workpiece adjacent a third means having a third cavity therein, said third cavity being provided with a concave surface, engaging said one side of said workpiece by a third convexly arcuate member and forcing said workpiece into said third cavity for substantially assuming the contour thereof, and then engaging said opposite side of said workpiece and forcing said opposite edges into adjacency.

43. A threaded part as recited in claim 42 in which for said step of engaging said opposite side of said workpiece for bringing said opposite edges into adjacency, said workpiece is engaged by opposed means, each of which has a cavity therein.

44. A threaded part as recited in claim 39 in which for said step of bending said workpiece into a substantially cylindrical shape said workpiece is engaged on the opposite side thereof by a first means having a cavity of predetermined contour therein, and is engaged on said one side by a second means for forcing said workpiece into said cavity for assuming the contour thereof, said second means being provided with ridges thereon complementary to said grooves on said one side of said workpiece, whereby said second means when so engaging said workpiece does not distort said grooves on said one side of said workpiece, and then said workpiece is engaged on said opposite side for bringing said opposite edges thereof into adjacency.

45. A threaded part as recited in claim 44 in which in said steps one cylindrical threaded shank is used for said second means.

46. A threaded part as recited in claim 44 in which in said steps said second means includes two spaced parallel elements, each of which is so provided with said ridges complementary to said grooves on said one side of said workpiece.

47. A threaded part as recited in claim 44 in which in said steps said cavity in said first means is provided with two concave portions opposite from said two spaced parallel elements, and a convex portion between said concave portions, and in which said first means is provided with a second cavity therein having a concave surface having greater curvature than that of said first-mentioned cavity, said second means is provided with a member opposite said concave surface of said second cavity, said workpiece being engaged by said member of said second means and forced into said second cavity to substantially assume the contour thereof subsequent to said engagement by said two elements for forcing said workpiece into said first-mentioned cavity.

48. A threaded part as recited in claim 44 in which in said steps said member of said second means is provided with an arcuate surface opposite said second cavity and relatively flatter surfaces alongside said arcuate surface for providing clearance between said opposite edges of said workpiece for said member of said second means when said member of said second means is withdrawn from said workpiece.

49. A threaded part as recited in claim 44 in which in said steps said ridges on said member of said second means are extended from said arcuate surface onto said relatively flatter surfaces for avoiding distortion of said grooves in said workpiece when said workpiece is forced into said second cavity by said member of said second means.

50. A threaded part having a longitudinal split and a regular cylindrical shape made by the steps of forming in one side of a workpiece a plurality of parallel grooves extending from adjacent a first edge of said workpiece to adjacent a second edge of said workpiece opposite from said first edge, with said grooves being given a cross section corresponding substantially to the cross sectional configuration of a screw thread, and being spaced apart a distance corresponding to the pitch of said screw thread, then engaging said one side of said workpiece by means having ridges thereon corresponding in configuration to the configuration of said screw thread and forcing said workpiece on the opposite side thereof into a recess in a die so as to impart a curvature to said workpiece while substantially preserving the shape of said grooves, and then, while making no engagement with said one side of said workpiece, engaging said opposite side and bringing said first and second edges into adjacency so as to impart a greater curvature and giving a substantially cylindrical configuration to said workpiece with the ends of adjacent ones of said grooves in alignment with each other at said first and second edges to define a helix and produce a screw thread on said workpiece.

51. A threaded part as recited in claim 50 in which in said steps said means having ridges thereon is engaged with less than the full surface of said one side of said workpiece.

52. A threaded part as recited in claim 50 in which said part has a swaged thread which is well-formed, accurately shaped, uniform, and strong, and in which in said step of forming said grooves said one side of said workpiece is struck by punch means a plurality of times for progressively imparting the counter of said threads to said one side of said workpiece.

53. A threaded part as recited in claim 52 in which in said step of progressively imparting the contour of said threads to said one side of said workpiece said punch means first produces grooves shallower than the depth of said threads, and then deepens said grooves to equal the depth of said threads.

54. A threaded part as recited in claim 52 in which in said step of progressively imparting the contour of said threads said one side of said workpiece said punch means first produces grooves having opposed sidewalls with at least some of said sidewalls being more steeply inclined than the flanks of said thread, and said punch means then forms said sidewalls to incline at the same angle as said flanks of said threads.

55. A threaded part as recited in claim 52 in which in said step of progressively imparting the contour of said threads to said one side of said workpiece said punch means first produces grooves having opposed sidewalls and a bottom wall interconnecting said sidewalls, with at least some of said sidewalls being more steeply inclined than the flanks of said threads and said bottom walls spaced beneath the outer surface of said one side of said workpiece a distance less than the depth of the root of said thread, and said punch means then imparts to said sidewalls the inclination of the flanks of said thread and depresses said bottom wall to the depth of the root of said thread.

56. A threaded part as recited in claim 54 in which in said steps said workpiece is provided with third and fourth edges interconnecting said first and second edges, said third and fourth edges being made opposite from each other, and including the step of confining said workpiece at said third edge while allowing expansion of said workpiece at said fourth edge while said workpiece is struck by said punch means, and in which said punch means in so progressively imparting the contour of said threads to said one side of said workpiece first produces grooves having first and second opposed sidewalls with said first sidewalls being adjacent said fourth edge and said second sidewalls being adjacent said third edge, said punch means first imparting an inclination to said first sidewalls which is steeper than the flanks of said thread and then imparting an inclination to said first sidewalls which corresponds to the inclination of said flanks of said thread.

57. A threaded part as recited in claim 56 in which said punch means in so progressively imparting the contour of said threads to said one side of said workpiece first imparts a slope of substantially 17° to said first sidewalls and substantially 30° to said second sidewalls relative to a line perpendicular to said one side of said workpiece, then imparts a slope of substantially 23° to said first sidewalls while retaining said second sidewalls at a slope of substantially 30° relative to said line, and then imparts a slope of substantially 30° to said first sidewalls while retaining said second sidewalls at a slope of substantially 30° relative to said line.

58. A threaded part having a longitudinal split made by the steps of forming in one side of a workpiece a plurality of parallel grooves extending from adjacent a first edge of said workpiece to adjacent a second edge of said workpiece opposite from said first edge, with said grooves being given a cross section corresponding to the cross sectional configuration of a screw thread, and being spaced apart a distance corresponding to the pitch of said screw thread, then bending said wokpiece so as to provide a curvature adjacent said first and second edges which is concave on said one side of said workpiece, and a curvature at the intermediate portion of said workpiece which is convex on said one side of said workpiece, then imparting a curvature at said intermediate portion which is concave on said one side of said workpiece, and then bringing said first and second edges into adjacency to impart a substantially cylindrical configuration to said workpiece with the ends of adjacent ones of said grooves in alignment with each other at said first and second edges to define a helix and produce a screw thread on said workpiece.

59. A threaded part as recited in claim 58 in which said part has a swaged thread which is well-formed, accurately shaped, uniform, and strong, and in which all of said steps are accomplished by engaging said workpiece on opposite sides by members relatively moving rectilinearly toward each other to provide an impact on said workpiece, and said bending of said workpiece, said imparting a curvature at said intermediate portion and said bringing said first and second edges into adjacency are accomplished without the use of a mandrel.

60. A threaded part as recited in claim 59 in which in said steps the opposite side of said workpiece is supported on one of said members, and said one side is struck by another of said members moving rectilinearly toward said one member.

61. A threaded part as recited in claim 58 in which said part has a swaged thread which is well-formed, accurately shaped, uniform, and strong, and in which in said step of forming said grooves, the opposite side of said workpiece is positioned on a supporting surface and said one side of said workpiece is engaged by a first member so as to produce relatively shallow grooves in said one side, and then engaged by a second member so as to produce relatively deeper grooves in said one side.

62. A threaded part as recited in claim 61 in which in said steps said workpiece is provided with third and fourth edges interconnecting said first and second edges, said third and fourth edges being opposite from each other, and in forming said grooves said third edge is restrained so as to prevent movement of material in the direction of said third edge and said fourth edge is unrestrained to permit movement of material in the direction of said fourth edge, and said grooves are provided with first walls adjacent said third edge and second walls adjacent said fourth edge with said walls diverging upwardly, and when said first member engages said workpiece said second walls are made steeper than said first walls, and when said second member engages said workpiece said second walls are given an inclination substantially the same as that of said first walls.

63. A threaded part as recited in claim 58 in which said part has a swaged thread which is well-formed, accurately shaped, uniform, and strong, and in which for forming said grooves the opposite side of said workpiece is positioned on a supporting surface and said one side of said workpiece is engaged by first, second, and third members so as to produce grooves in said one side which are made progressively deeper by said first, second, and third members, said workpiece is provided with third and fourth edges interconnecting said first and second edges, said third and fourth edges being opposite from each other, said third edge is restrained when said one side of said workpiece is engaged by said first, second, and third member so as to prevent movement of material in the direction of said third edge and said fourth edge is unrestrained when said one side of said workpiece is so engaged to permit movement of material in the direction of said fourth edge, said grooves are provided with first walls adjacent said fourth edge and second walls adjacent said third edge with said walls diverging upwardly, and when said first member engages said workpiece said first walls are given a slope of approximately 17° and said second walls are given a slope of approximately 30° relative to a line perpendicular to said one side of said workpiece, when said second member engages said workpiece said first walls are given a slope of approximately 23° and second walls are retained at a slope of approximately 30° relative to said line, and when said third member engages said workpiece said first walls are given a slope of approximately 30° and said second walls are retained at a slope of approximately 30° relative to said line.

64. A threaded part as recited in claim 62 which has an integral operative element extending outwardly from said third edge, and in which in said steps said workpiece is provided integrally with an operative element extending outwardly from said third edge.

65. A threaded part as recited in claim 62 in which in said step of forming said grooves, the opposite side of said workpiece is positioned on a substantially flat supporting surface, and said one side of said workpiece is struck successively by first, second, and third punch members having ridges thereon for forming said grooves, said grooves being formed progressively deeper when said workpiece is engaged by said first, second, and third punch members.

66. A threaded part as recited in claim 58 in which in said step of providing said concave curvature adjacent said first and second edges and said convex curvature at the intermediate portion of said workpiece, said workpiece is positioned on a die having concave edge portions and a convex central portion, and said one side of said workpiece is engaged by punch elements substantially aligned with said concave sections, said punch elements having the configurations of screw threads on their lower surfaces, which configurations conform to the configurations of said grooves.

67. A threaded part as recited in claim 62 in which in said steps said fourth edge is made substantially perpendicular to said first and second edges, and said grooves are formed at a shallow angle relative to said fourth edge for providing a helix for said screw thread when said first and second edges are so brought into adjacency.

68. A progressive forming arrangement for producing threaded parts comprising a plurality of dies, and a plurality of punches movable simultaneously so that they reciprocate through a stroke toward and away from said dies in a rectilinear path such that at one end of the stroke said punches are adjacent said dies and at the opposite end of the stroke said punches are remote from said dies, and dies and punches including a first stage including at least one supporting die surface, and at least one first punch having parallel ridges thereon for producing grooves in a workpiece supported on said first supporting die surface, a second stage including a second supporting die surface, and a second punch having parallel ridges thereon, said ridges of said second punch having the same spacing as said ridges of said first punch and being closer to said second supporting die surface than said ridges of said first punch are to said first supporting die surface at said one end of said stroke for deepening said grooves in said workpiece, a third stage including at least one third die having a cavity, and at least one third punch having ridges thereon corresponding to said ridges of said second punch for forcing said workpiece into said cavity without substantially distorting said grooves, said cavity facing toward said third punch and having concave side edge portions and a convex intermediate portion, a fourth stage including a fourth die, and a fourth punch with ridges thereon corresponding to said ridges of said second punch for forcing said workpiece into said cavity of said fourth die without substantially distorting said grooves, said fourth die having a cavity facing toward said fourth punch and having a concave surface at its outer side edges and a concave surface at its intermediate portion, and a fifth stage including a fifth die, and a fifth punch, said fifth die and fifth punch having concave surfaces cooperating to define a closed curve of predetermined dimension for imparting a substantially complementary curve to said workpiece with said grooves providing a screw thread.

69. A device as recited in claim 68 including an additional stage means prior to said first stage, said additional stage means including, an additional supporting die surface, and an additional punch, said additional punch including, means having an inclined wall for producing an additional groove in said workpiece, with said additional groove having an inclined wall, and means for cutting said workpiece to remove a portion thereof beyond said additional groove so as to provide said workpiece with an edge with said inclined wall of said workpiece being inwardly of said edge, whereby said grooves produced at said first and said second stages are recessed from said edge by said inclined wall.

70. A device as recited in claim 69 in which said means of said additional punch includes a substantially V-shaped member having a flattened bottom edge for providing said additional groove with divergent walls and a flat bottom wall, and said means for cutting said workpiece includes means for producing said edge at the location of said flat bottom wall of said additional groove, whereby said inclined wall of said workpiece bevel is caused to be located inwardly of said edge.

71. A device as recited in claim 70 including in addition a stop for engaging the portion of said workpiece beyond said additional groove, whereby when said workpiece is cut by said second additional punch, said workpiece is free to advance incrementally in said plurality of dies and plurality of punches.

72. A device as recited in claim 68 in which said ridges on said first and second punches have opposite sidewalls, at least some of said sidewalls of said second punch being more shallow than the corresponding sidewalls of said ridges of said first punch.

73. A device as recited in claim 68, in which said first stage includes two punches having parallel ridges thereon, and two supporting die surfaces opposite said two punches, said additional stage including an additional supporting die surface, and an additional punch, said parallel ridges of one of said two punches being closer to the opposite one of said two supporting surfaces than said ridges of the other of said two punches are to the other of said two supporting die surfaces at said one end of said stroke, but not as close as said ridges of said second punch are to said second supporting surface at said one end of said stroke, for progressively deepening said grooves in said workpiece.

74. A device as recited in claim 73, in which said ridges on said two punches and second punch have opposite sidewalls, at least some of said sidewalls of said other of said two punches being more shallow in inclination than the corresponding sidewalls on said first of one of said two punches, and at least some of said sidewalls of said second punch being more shallow in inclination than said sidewalls of said other of said two punches.

75. A device as recited in claim 74, including, in addition, means for confining one edge of said workpiece at said first, second, and additional stages while leaving the opposite edge of said workpiece unconfined.

76. A device as recited in claim 74, including, in addition, means for confining one edge of said workpiece at said first, second, and additional stages while leaving the opposite edge of said workpiece unconfined, said sidewalls of said first, second, and additional punches including first sidewalls adjacent said confining means and second sidewalls remote from said confining means, said second sidewalls of said first, second, and third punches being inclined at substantially 17°, 23°, and 30°, respectively, relative to the direction of said rectilinear path, said first sidwalls of said first, second, and third punches being inclined at substantially 30°, relative to the direction of said rectilinear path.

77. A device as recited in claim 68 in which said third punch includes spaced elements opposite said concave outer side edges of said cavity in said third die, for thereby forcing said workpiece into said concave outer side edge portions of said cavity and over said intermediate convex portion of said cavity.

78. A device as recited in claim 77 in which said spaced elements are threaded studs.

79. A device as recited in claim 68 including an additional stage between said third stage and said fourth stage, said additional stage including a die and a punch, said die of said additional stage having a cavity having concave outer side edge portions and a convex intermediate portion, said concave outer side edge portions of said die of said additional stage being closer together than are said concave outer side edge portions of said third die, said punch of said additional stage having means for forcing said workpiece into said outer side edge portions of said die of said additional stage.

80. A device as recited in claim 79 including a second additional stage between said first-mentioned additional stage and said fourth stage, said second additional stage including a second additional die, and a second additional punch, said second additional die having a cavity having concave outer side edge portions and a convex intermediate portion, said concave outer side edge portions of said second additional die being closer together than are said concave outer side edge portions of said first-mentioned additional die, said second additional punch having means for forcing said workpiece into said outer side edge portions of said second additional die.

81. A device as recited in claim 80 in which said second additional punch comprises spaced elements.

82. A device as recited in claim 81 in which said spaced elements of said second additional punch are threaded studs.

83. A device as recited in claim 82 in which said threaded studs have flattened outer sidewalls for providing clearance for removal of said second additional punch from said workpiece.

84. A device as recited in claim 83 in which the threads of said threaded studs extend into said flattened outer walls for avoiding distortion of said grooves in said workpiece.

85. A device as recited in claim 68 including an additional stage between said fourth and fifth stages, said additional stage including an additional punch, and an additional die, said additional punch and said additional die including concave surfaces cooperating to define a closed curve having a perimeter greater than the perimeter of said opening defined by said fifth punch and fifth die.

86. A device as recited in claim 85 in which said closed curve of said additional punch and additional die is no wider in a direction normal to said rectilinear path than is said opening defined by said fifth punch and fifth die.

87. A device as recited in claim 86 in which said closed curve of said additional stage is substantially elliptical.

88. A device as recited in claim 85 in which said first punch and said second punch include abutment means for engaging one side edge of a workpiece for preventing expansion of said workpiece in one direction in response to compression thereof by said first and second punches.

89. A method of making a substantially cylindrical threaded sheet-metal part by using only a punch press, without rolling or tapping, said method comprising:

(a) providing a piece of sheet metal, (b) placing said piece in a punch press, certain dies of which are so constructed that closing of the press causes at least one side of said piece to have parallel but incomplete thread grooves, (c) closing said press to thus form said parallel but incomplete grooves in said one side, (d) moving said thus-formed piece in said press until it is between other die means in said press, which other die means are adapted in response to at least one additional closing of said press to complete said thread grooves, (e) effecting closing of said press to achieve said completion of said thread grooves, and (f) bending said thus-grooved piece into substantially cylindrical shape and in such relationship that said thread grooves are arranged along a substantially helical path, whereby the substantially cylindrical threaded part may be threadedly associated with a complementary threaded member.

90. A method of forming high-quality thread grooves by means of a punch press, using only rectilinear motion of the press, without any thread-rolling or thread-tapping operations, said method comprising:

(a) providing a sheet metal workpiece, (b) supporting one side of said workpiece on a die element, (c) moving forcibly against the other side of said supported workpiece a punch element having parallel ridges at least portions of which form said workpiece to create incomplete thread grooves, and (d) moving forcibly against said other side of said workpiece a punch element having parallel ridges at least portions of which penetrate into said incomplete thread grooves and further form said workpiece to complete said grooves.

91. The invention as claimed in claim 90, in which said method further comprises causing said workpiece to expand in at least one direction, along said supporting die element, as the result of said step (c), the direction of such expansion being transverse to said parallel ridges.

92. The invention as claimed in claim 91, in which to effect said expansion each of the ridges recited in clause (c) is caused to be asymmetrical, having a flank angle on one side thereof which is different from the flank angle on the other side thereof.

93. The invention as claimed in claim 92, in which apex regions of said die ridges are caused to be rounded in order to further effect said expansion.

94. A method of manufacturing a threaded tubular part from sheet metal, without the necessity of performing any thread-rolling or thread-tapping steps, said method comprising:

(a) providing in a punch-press means at least two sets of thread dies, each of said sets including a punch having parallel ridges the flanks of which converge toward the workpiece, at least one of said sets having the flanks on one side of its ridges at an angle, relative to the direction of press movement, far different from the angle of the flanks on the other side thereof, at least one other of said sets having the flanks on one side of its ridges at substantially the same angle, relative to the direction of press movement, as the angle of the flanks on the other side thereof, said same angle being that which it is desired to achieve in the completed threaded tubular part, (b) operating on a sheet metal workpiece in said punch-press means first by said one die set and subsequently by said other die set, to form completed threads, and (c) bending the resulting threaded workpiece into a substantial cylinder in such manner that said threads lie along a substantially helical path.

95. A method of forming high-quality uniform threads while achieving a long die life, which method comprises:

(a) compressing at least part of a sheet-metal workpiece between a first rectilinearly-moving thread punch means and a support, said first punch means having parallel ridges which converge toward said workpiece, one set of corresponding flanks of said ridges being relatively steep, the remaining set of corresponding flanks of said ridges being relatively shallow, (b) compressing at least said part of said workpiece between a second rectilinearly-moving punch means and a support, said second punch means also having parallel ridges which converge toward said workpiece, one set of corresponding flanks of said ridges being relatively steep the remaining set of corresponding flanks being relatively shallow, said relatively steep flanks being less steep than those of said relatively steep flanks of said first punch means, and being on the same sides of the ridges as are said relatively steep flanks of said first punch means, said relatively shallow flanks having substantially the same angles as said relatively shallow flanks of said first punch means, said compressing step (b) being effected by causing said shallow flanks to register with the corresponding workpiece flanks caused by said step (a), and by moving said ridges of said second punch means deeper into said workpiece, and (c) compressing at least said part of said workpiece between a third rectilinearly-moving punch means and a support, said third punch means also having parallel ridges which converge toward said workpiece, both sets of flanks of said ridges being relatively shallow and at substantially the same angles as said relatively shallow flanks of said first punch means, said compressing step (c) being effected by causing said shallow flanks of said third punch means to register with the corresponding workpiece flanks caused by said steps (a) and (b), and by moving the ridges of said third punch means deeper into said workpiece.

96. A method of forming threads in a sheet metal workpiece, comprising:

(a) effecting at least two stages of thread groove formation in said workpiece, by means of only rectilinearly-moving dies, and (b) causing said workpiece to grow in only a single direction during said thread groove formation, said direction being lateral to said threads and in the plane of said workpiece, said method being such that the thread grooves do not spread apart or change pitch.

97. A method of forming threads in a sheet metal workpiece, comprising:

(a) effecting at least two stages of thread groove formation in said workpiece, by means of only rectilinearly-moving thread dies, and (b) causing said workpiece to grow in two opposite directions during said thread groove formation, both of said directions being lateral to said threads and in the plane of said workpiece, said method being such that the thread grooves do not spread apart or change pitch.

98. A method of forming threaded parts in a punch press comprising:

(a) providing a first thread punch which has parallel thread-forming ridges thereon for striking against a metal workpiece, said ridges each being asymmetrical in that the flank on one side thereof is more steeply inclined, relative to the direction of press movement, than is the flank on the other side thereof, (b) providing a second thread punch which has parallel thread-forming ridges thereon for striking against a metal workpiece, each of said ridges of said second thread punch being symmetrical in that the flanks on both sides thereof have generally the same inclination, relative to the direction of press movement, and (c) forcing said first punch and then said second punch against a metal workpiece, while permitting said workpiece to expand in a plane perpendicular to said direction of press movement and in only a single direction relative to said ridges, said single direction being substantially perpendicular to said ridges.

99. A method of forming threaded sheet-metal parts in a punch press, which comprises:

(a) forcing downwardly into a sheet-metal workpiece, in response to closing of the punch press, a die having parallel ridges on its lower side, each of said ridges having downwardly-convergent sides and rounded lower corners, whereby to effect an initial thread-forming operation, (b) subsequently forcing downwardly into the thus initially-formed part a second die having parallel ridges on its lower side and which register with the grooves in the initially formed part, each of said ridges of said second die having rounded lower corners, said subsequent downward movement being sufficiently extensive to deepen the thread grooves in said part, and (c) thereafter bending said threaded parts into generally cylindrical shape.

100. A method of forming threads in sheet-metal parts without the need for any rolling or tapping, and with minimized danger of metal lock and punch or die breakage, said method comprising:

(a) forcing into one side of a metal workpiece a punch having parallel thread-forming ridges, and (b) discontinuing said forcing step (a) before there is any contact between said punch and said workpiece at regions between said ridges, whereby open spaces are defined between said ridges and between said punch and workpiece even when said punch is at the bottom of its stroke.

101. The invention as claimed in claim 100, in which said steps (a) and (b) are thereafter repeated in such manner as to progressively deepen and widen the grooves formed in said workpiece by said ridges.

102. The invention as claimed in claim 5, in which the amount of penetration of said ridges into said workpiece is insufficient to cause said workpiece to be contacted by the regions of said punch between said ridges.

103. A method of forming screw threads, comprising:

(a) forcing a punch ridge into one surface of a sheet-metal workpiece to thus form in said workpiece a groove of predetermined cross-sectional size and shape, said shape being such that there is a bottom wall and two downwardly-converging side flanks, said side flanks being at different angles such that projections thereof below said bottom wall intersect at a line distinctly to one side of the center of said bottom wall, and (b) forcing another punch ridge into said thus-formed groove to change the cross-sectional size and shape thereof, said change being such that said bottom wall is lower and less wide, and said side flanks are at the same angle causing projections thereof below said bottom wall to intersect at a line directly below the center of said bottom wall, said steps (a) and (b) being so performed that said lines are coincident with each other.

104. The invention as claimed in claim 103, in which there are many grooves thus formed in parallel relationship, and in which the distance between said lines of intersection for adjacent grooves is the same relative to both of said steps (a) and (b).

105. A method of forming high quality threads in a sheet metal workpiece, said method comprising:

(a) providing a sheet metal workpiece on a support, (b) forcing downwardly into the upper surface of said workpiece a punch having a plurality of parallel thread-forming ridges on the lower side thereof, each of said ridges having downwardly-convergent side flanks, neither of which is more shallow than the flank angle of the desired thread groove, and at least one of which is more steep than the flank angle of the desired thread groove, said step (b) being discontinued well before the bottoms of said ridges penetrate to the full depth of the desired thread groove, and (c) subsequently forcing downwardly into said upper surface another punch having on the lower side thereof a plurality of parallel thread-forming ridges which register with the incomplete grooves formed in said workpiece by said step (b), each of said ridges of said other punch also having downwardly-convergent side flanks, the included angle between said flanks being substantially greater than the included angle between said flanks of said first-mentioned punch, each ridge of said other punch having flanks both of which are at substantially the flank angle of the desired thread groove, said step (c) being continued until the bottoms of said ridges of said other punch penetrate to substantially the full depth of the desired thread grooves.

106. The method as recited in claim 105, in which said method is so performed that said incomplete grooves and the final grooves are at the same lateral distance relative to each other, and do not spread apart or grow from stage to stage, but said workpiece does grow laterally in its own plane and in at least one direction substantially perpendicular to said grooves.

107. The method as recited in claim 105, in which both flanks of each of said ridges of said first-mentioned punch are at the same angle relative to the direction of punch movement, and both flanks of each of said ridges of said second punch are at the same angle relative to the direction of punch movement, each of said ridges being symmetrical.

108. The method as claimed in claim 105, in which said method is so performed that, when said punches are at the bottoms of their strokes, there are substantial open spaces defined above said workpiece and between the punch ridges.

109. The method as claimed in claim 105, in which the bottoms of said ridges of said punches are rounded.

110. The method as claimed in claim 105, in which said each of said ridges of said first-mentioned punch is asymmetrical, the side flanks thereof being at different inclinations.

111. A method of forming high quality threads in a sheet metal workpiece, said method comprising:

(a) providing a sheet metal workpiece on a support, (b) forcing downwardly into the upper surface of said workpiece a punch having a plurality of parallel thread-forming ridges on the lower side thereof, each of said ridges having downwardly-convergent side flanks, neither of which is more shallow than the flank angle of the desired thread groove, and at least one of which is more steep than the flank angle of the desired thread groove, said step (b) being discontinued well before the bottoms of said ridges penetrate to the full depth of the desired thread groove, and (c) subsequently forcing downwardly into said upper surface another punch having on the lower side thereof a plurality of parallel thread-forming ridges which register with the incomplete grooves formed in said workpiece by said step (b), each of said ridges of said other punch also having downwardly-convergent side flanks, the included angle between said flanks being substantially greater than the included angle between said flanks of said first-mentioned punch, each ridge of said other punch having flanks both of which are at substantially the flank angle of the desired thread groove, said step (c) being continued until the bottoms of said ridges of said other punch penetrate to substantially the full depth of the desired thread grooves, said method being so performed that said incomplete grooves and the final grooves are at the same lateral distance relative to each other and do not spread apart or grow from stage to stage, but said workpiece does grow laterally in its own plane and in at least one direction perpendicular to said grooves, said method being so performed that, when said punches are at the bottoms of their strokes, there are substantial open spaces defined above said workpiece and between the punch ridges.

112. The method as claimed in claim 111, in which both flanks of each of said ridges of said first-mentioned punch are at the same angle relative to the direction of punch movement, and both flanks of each of said ridges of said second punch are at the same angle relative to the direction of punch movement, each of said ridges being symmetrical.

113. The invention as claimed in claim 111, in which said each of said ridges of said first-mentioned punch is asymmetrical, the side flanks thereof being at different inclinations.

114. A method of forming high quality threads in a thread metal workpiece, said method comprising:

(a) providing a sheet metal workpiece on a support, (b) forcing downwardly into the upper surface of said workpiece a punch having a plurality of parallel thread-forming ridges on the lower side thereof, each of said ridges having downwardly-convergent side flanks, neither of which is more shallow than the flank angle of the desired thread groove, and at least one of which is more steep than the flank angle of the desired thread groove, said step (b) being discontinued well before the bottoms of said ridges penetrate to the full depth of the desired thread groove, (c) forcing downwardly into the upper surface of said workpiece a second punch having on the lower side thereof a plurality of thread-forming ridges which register with the incomplete grooves formed in said workpiece by said step (b), each of said ridges of said second punch also having downwardly-convergent side flanks, the included angle between said flanks being substantially greater than the included angle between said ridges of said first-mentioned punch, but neither flank of said second punch being more shallow than the flank angle of the desired thread groove and at least one flank being more steep than the flank angle of the desired thread groove, said step (c) being continued until the bottoms of said ridges of said second punch penetrate further into said workpiece but to a depth substantially less than the full depth of the desired thread groove, and (d) subsequently forcing downwardly into said upper surface an additional punch having on the lower side thereof a plurality of parallel thread-forming ridges which register with the incomplete grooves formed in said workpiece by said steps (b) and (c), each of said ridges of said additional punch also having downwardly-convergent side flanks, the included angle between said flanks being substantially greater than the included angle between said flanks of said second punch, each ridge of said additional punch having flanks both of which are at substantially the flank angle of the desired thread groove, said step (d) being continued until the bottoms of said ridges of said additional punch penetrate to substantially the full depth of the desired thread groove.

115. The invention as claimed in claim 114, in which said method is so performed that said grooves resulting from said steps (b) and (c) and (d) are all at the same lateral distance relative to each other, and do not spread apart or grow from stage to stage, but said workpiece does grow laterally in its own plane and in at least one direction perpendicular to said grooves.

116. The invention as claimed in claim 114, in which both flanks of each of said ridges of said first-mentioned punch are at the same angle relative to the direction of punch movement, and both flanks of each of said ridges of said second punch are at the same angle relative to the direction of punch movement, and both flanks of each of said ridges of said additional punch are at the same angle relative to the direction of punch movement, each of said ridges being symmetrical.

117. The invention as claimed in claim 116, in which the angle between each flank of each of said ridges of said first-mentioned punch and a line perpendicular to said workpiece is about 23°, and the angle between each flank of each of said ridges of said second punch and a line perpendicular to said workpiece is about 26°, and the angle between each flank of each of said ridges of said additional punch and a line perpendicular to said workpiece is about 30°.

118. The invention as claimed in claim 114, in which said method is so performed that, when each of said punches is at the bottom of its stroke, there are substantial open spaces defined above said workpiece and between the punch ridges.

119. The invention as claimed in claim 114, in which the bottoms of said ridges of each of said punches are rounded.

120. The invention as claimed in claim 114, in which each of said ridges of said first-mentioned punch is asymmetrical, the side flanks thereof being of different inclinations, in which each of said ridges of said second punch is also asymmetrical, the side flanks thereof being of different inclinations, and in which each of said ridges of said additional punch is symmetrical.

121. The invention as claimed in claim 114, in which said method further comprises curving the thus-grooved workpiece into substantially cylindrical shape in such manner that the thread grooves lie along a substantially helical path.

122. The method as recited in claim 18, in which in so progressively imparting the contour of said threads to said one side of said workpiece, said punch means first produces grooves having opposed side walls and a bottom wall interconnecting said side walls, both of said opposed side walls being more steeply inclined than the flanks of said thread and said bottom wall being spaced beneath the outer surface of said one side of said workpiece a distance less than the depth of the root of said thread, and said punch means then imparts to said sidewalls the inclinations of the flanks of said thread and depresses said bottom wall to the depth of the root of said thread.

123. The invention as claimed in claim 122, in which said bottom wall when first produced by said punch means is wider than when so depressed to the depth of the root of said thread.

124. The method as claimed in claim 18, in which said workpiece is provided with third and fourth edges interconnecting said first and second edges, said third and fourth edges being made opposite from each other and being unconfined when said workpiece is so struck by said punch means, and in which said punch means in so progressively imparting the contour of said threads to said one side of said workpiece first produces grooves having first and second downwardly-convergent opposed side walls both of which are at the same angle relative to a line perpendicular to the workpiece but each of which is at a smaller angle relative to said line than is each wall of the finished thread, and in which said punch means is caused to penetrate more deeply into said workpiece during each of said strokes.

125. The method as recited in claim 25, in which for forming said grooves the opposite side of said workpiece is positioned on a supporting surface and said one side of said workpiece is engaged by first, second and third members so as to produce grooves in said one side which are made progressively deeper by said first, second and third members, said workpiece is provided with third and fourth edges interconnecting said first and second edges, said third and fourth edges being opposite from each other, both of said edges being unrestrained when one side of said workpiece is engaged by said first, second and third members so as to permit movement of material in both directions when said one side of said workpiece is so engaged, said grooves are provided with first walls adjacent said fourth edge and second walls adjacent said third edge with said walls diverging upwardly, and when said first member engages said workpiece said first and second walls are each given a scope of approximately 23° relative to a line perpendicular to said one side of said workpiece, when said second member engages said workpiece said first and second walls are each given a scope of approximately 26° relative to said line, and when said third member engages said workpiece said first and second walls are each given a scope of approximately 30° relative to said line.

126. The method as claimed in claim 28, in which said workpiece is provided with third and fourth edges interconnecting said first and second edges, said third and fourth edges being opposite from each other, and in forming said grooves said third and fourth edges are unrestrained to permit movement of material outwardly in the direction of said third and fourth edges, and in which said first and second members are so constructed that when said first member engages said workpiece both groove walls are caused to have substantially the same angle, both of said walls being steeper than the walls of the finished groove, and when said second member engages said workpiece said walls are given the same inclination which is substantially the desired inclination of the walls of the finished groove.

127. A product having a swaged thread which is well-formed, accurately shaped, uniform, and strong which was formed by the process of (a) providing a piece of sheet metal, (b) placing said piece in a punch press, certain dies of which are so constructed that closing of the press causes at least one side of said piece to have parallel but incomplete thread grooves, (c) closing said press to thus form said parallel but incomplete grooves in said one side, (d) moving said thus-formed piece in said press until it is between other die means in said press, which other die means are adapted in response to at least one additional closing of said press to complete said thread grooves, (e) effecting closing of said press to achieve said completion of said thread grooves, and (f) bending said thus-grooved piece into substantially cylindrical shape and in such relationship that said thread grooves are arranged along a substantially helical path, whereby the substantially cylindrical threaded part may be threadedly associated with a complementary threaded member.

128. A product having a swaged thread which is well-formed, accurately shaped, uniform, and strong which was formed by the process of (a) providing a sheet metal workpiece, (b) supporting one side of said workpiece on a die element, (c) moving forcibly against the other side of said supported workpiece a punch element having parallel ridges at least portions of which form said workpiece to create incomplete thread grooves, and (d) moving forcibly against said other side of said workpiece a punch element having parallel ridges at least portions of which penetrate into said incomplete thread grooves and further form said workpiece to complete said grooves.

129. A product having a swaged thread which is well-formed, accurately shaped, uniform, and strong which was formed by the process of (a) providing in a punch-press means at least two sets of thread dies, each of said sets including a punch having parallel ridges the flanks of which converge toward the workpiece, at least one of said sets having the flanks on one side of its ridges at an angle, relative to the direction of press movement, far different from the angle of the flanks on the other side thereof, at least one other of said sets having the flanks on one side of its ridges at substantially the same angle, relative to the direction of press movement, as the angle of the flanks on the other side thereof, said same angle being that which it is desired to achieve in the completed threaded tubular part, (b) operating on a sheet metal workpiece in said punch-press means first by said one die set and subsequently by said other die set, to form completed threads, and (c) bending the resulting threaded workpiece into a substantial cylinder in such manner that said threads lie along a substantially helical path.

130. A product having a swaged thread which is well-formed, accurately shaped, uniform, and strong which was formed by the process of (a) compressing at least part of a sheet-metal workpiece between a first rectilinearly-moving thread punch means and a support, said first punch means having parallel ridges which converge toward said workpiece, one set of corresponding flanks of said ridges being relatively steep, the remaining set of corresponding flanks of said ridges being relatively shallow, (b) compressing at least said part of said workpiece between a second rectilinearly-moving punch means and a support, said second punch means also having parallel ridges which converge toward said workpiece, one set of corresponding flanks of said ridges being relatively steep, the remaining set of coresponding flanks being relatively shallow, said relatively steep flanks being less steep than those of said relatively steep flanks of said first punch means, and being on the same sides of the ridges as are said relatively steep flanks of said first punch means, said relatively shallow flanks having substantially the same angles as said relatively shallow flanks of said first punch means, said compressing step (b) being effected by causing said shallow flanks to register with the corresponding workpiece flanks caused by said step (a), and by moving said ridges of said second punch means deeper into said workpiece, and (c) compressing at least said part of said workpiece between a third rectilinearly-moving punch means and a support, said third punch means also having parallel ridges which converge toward said workpiece, both sets of flanks of said ridges being relatively shallow and at substantially the same angles as said relatively shallow flanks of said first punch means, said compressing step (c) being effected by causing said shallow flanks of said third punch means to register with the corresponding workpiece flanks caused by said steps (a) and (b), and by moving the ridges of said third punch means deeper into said workpiece.

131. A product having a swaged thread which is well-formed, accurately shaped, uniform, and strong which was formed by the process of (a) effecting at least two stages of thread groove formation in said workpiece, by means of only rectilinearly-moving thread dies, and (b) causing said workpiece to grow in two opposite directions during said thread groove formation, both of said directions being lateral to said threads and in the plane of said workpiece, said method being such that the thread grooves do not spread apart or change pitch.

132. A product having a swaged thread which is well-formed, accurately shaped, uniform, and strong which was formed by the process of (a) providing a first thread punch which has parallel thread-forming ridges thereon for striking against a metal workpiece, said ridges each being asymmetrical in that the flank on one side thereof is more steeply inclined, relative to the direction of press movement, than is the flank on the other side thereof, (b) providing a second thread punch which has parallel thread-forming ridges thereon for striking against a metal workpiece, said ridges each being symmetrical in that the flanks on both sides thereof have generally the same inclination, relative to the direction of press movement, as do the flanks on said other side of said thread punch, and (c) forcing said first punch and then said second punch against a metal workpiece, while permitting said workpiece to expand in a plane perpendicular to said direction of press movement and in only a single direction relative to said ridges, said single direction being substantially perpendicular to said ridges.

133. A product having a swaged thread which is well-formed, accurately shaped, uniform, and strong which was formed by the process of (a) forcing downwardly into a sheet-metal workpiece, in response to closing of the punch press, a die having parallel ridges on its lower side, each of said ridges having downwardly-convergent sides and rounded lower corners, whereby to effect an initial thread-forming operation, (b) subsequently forcing downwardly into the thus initially-formed part a second die having parallel ridges on its lower side and which register with the grooves in the initially formed part, each of said ridges of said second die having rounded lower corners, said subsequent downward movement being sufficiently extensive to deepen the thread grooves in said part, and (c) thereafter bending said threaded parts into generally cylindrical shape.

134. A product which was formed by the process of (a) forcing into one side of a metal workpiece a punch having parallel thread-forming ridges, and (b) discontinuing said forcing step (a) before there is any contact between said punch and said workpiece at regions between said ridges, whereby open spaces are defined between said ridges and between said punch and workpiece even when said punch is at the bottom of its stroke.

135. A product having a swaged thread which is well-formed, accurately shaped, uniform, and strong which was formed by the process of (a) providing a sheet metal workpiece on a support, (b) forcing downwardly into the upper surface of said workpiece a punch having a plurality of parallel thread-forming ridges on the lower side thereof, each of said ridges having downwardly-convergent side flanks, neither of which is more shallow than the flank angle of the desired thread groove, and at least one of which is more steep than the flank angle of the desired thread groove, said step (b) being discontinued well before the bottoms of said ridges penetrate to the full depth of the desired thread groove, and (c) subsequently forcing downwardly into said upper surface another punch having on the lower side thereof a plurality of parallel thread-forming ridges which register with the incomplete grooves formed in said workpiece by said step (b), each of said ridges of said other punch also having downwardly-convergent side flanks, the included angle between said flanks being substantially greater than the included angle between said flanks of said first-mentioned punch, each ridge of said other punch having flanks both of which are at substantially the flank angle of the desired thread groove, said step (c) being continued until the bottoms of said ridges of said other punch penetrate to substantially the full depth of the desired thread grooves.

136. A product having a swaged thread which is well-formed, accurately shaped, uniform, and strong which was formed by the process of (a) providing a sheet metal workpiece on a support, (b) forcing downwardly into the upper surface of said workpiece a punch having a plurality of parallel thread-forming ridges on the lower side thereof, each of said ridges having downwardly-convergent side flanks, neither of which is more shallow than the flank angle of the desired thread groove, and at least one of which is more steep than the flank angle of the desired thread groove, said step (b) being discontinued well before the bottoms of said ridges penetrate to the full depth of the desired thread groove, and (c) subsequently forcing downwardly into said upper surface another punch having on the lower side thereof a plurality of parallel thread-forming ridges which register with the incomplete grooves formed in said workpiece by said step (b), each of said ridges of said other punch also having downwardly-convergent side flanks, the included angle between said flanks being substantially greater than the included angle between said flanks of said first-mentioned punch, each ridge of said other punch having flanks both of which are at substantially the flank angle of the desired thread groove, said step (c) being continued until the bottoms of said ridges of said other punch penetrate to substantially the full depth of the desired thread grooves, said method being so performed that said incomplete grooves and the final grooves are at the same lateral distance relative to each other and do not spread apart or grow from stage to stage, but said workpiece does grow laterally in its own plane and in at least one direction perpendicular to said grooves, said method being so performed that, when said punches are at the bottoms of their strokes, there are substantial open spaces defined above said workpiece and between the punch ridges.

137. A product having a swaged thread which is well-formed, accurately shaped, uniform, and strong which was formed by the process of (a) providing a sheet metal workpiece on a support, (b) forcing downwardly into the upper surface of said workpiece a punch having a plurality of parallel thread-forming ridges on the lower side thereof, each of said ridges having downwardly-convergent side flanks, neither of which is more shallow than the flank angle of the desired thread groove, and at least one of which is more steep than the flank angle of the desired thread groove, said step (b) being discontinued well before the bottoms of said ridges penetrate to the full depth of the desired thread groove, (c) forcing downwardly into the upper surface of said workpiece a second punch having on the lower side thereof a plurality of thread-forming ridges which register with the incomplete grooves formed in said workpiece by said step (b), each of said ridges of said second punch also having downwardly-convergent side flanks, the included angle between said flanks being substantially greater than the included angle between said ridges of said first-mentioned punch, but neither flank of said second punch being more shallow than the flank angle of the desired thread groove and at least one flank being more steep than the flank angle of the desired thread groove, said step (c) being continued until the bottoms of said ridges of said second punch penetrate further into said workpiece but to a depth substantially less than the full depth of the desired thread groove, and (d) subsequently forcing downwardly into said upper surface an additional punch having on the lower side thereof a plurality of parallel thread-forming ridges which register with the incomplete grooves formed in said workpiece by said steps (b) and (c), each of said ridges of said additional punch also having downwardly-convergent side flanks, the included angle between said flanks being substantially greater than the included angle between said flanks of said second punch, each ridge of said additional punch having flanks both of which are at substantially the flank angle of the desired thread groove, said step (d) being continued until the bottoms of said ridges of said additional punch penetrate to substantially the full depth of the desired thread groove.

138. A progressive forming arrangement for producing threaded parts comprising a plurality of dies, and a plurality of punches movable simultaneously so that they reciprocate through a stroke toward and away from said dies in a rectilinear path such that at one end of the stroke said punches are adjacent said dies and at the opposite end of the stroke said punches are remote from said dies, and dies and punches including a first stage including at least one supporting die surface, and at least one first punch having parallel ridges thereon for producing grooves in a workpiece supported on said first supporting die surface, a second stage including a second supporting die surface, and a second punch having parallel ridges thereon, said ridges of said second punch having the same spacing as said ridges of said first punch and being closer to said second supporting die surface than said ridges of said first punch are to said first supporting die surface at said one end of said stroke for deepening said grooves in said workpiece, said parallel ridges of said first punch each having downwardly converging flanks which are at the same angle relative to the direction of punch movement, so that each of said ridges is symmetrical, each of said flanks being steeper than the desired flank angle of the groove of the finished thread part, and in which said ridges of said second punch are at substantially the desired flank angle of the finished thread.

139. A progressive forming arrangement for producing threaded parts comprising a plurality of dies, and a plurality of punches movable simultaneously so that they reciprocate through a stroke toward and away from said dies in a rectilinear path such that at one end of the stroke said punches are adjacent said dies and at the opposite end of the stroke said punches are remote from said dies, and dies and punches including a first stage including at least one supporting die surfce, and at least one first punch having parallel ridges thereon for producing grooves in a workpiece supported on said first supporting die surface, a second stage including a second supporting die surface, and a second punch having parallel ridges thereon, said ridges of said second punch having the same spacing as said ridges of said first punch and being closer to said second supporting die surface than said ridges of said first punch are to said first supporting die surface at said one end of said stroke for deepening said grooves in said workpiece, said parallel ridges of said first punch each having downwardly converging flanks which are at different angles relative to the direction of punch movement, so that each of said ridges is asymmetrical, at least one of said flanks being steeper than the desired flank angle of the groove of the finished threaded part, and in which said ridges of said second punch are at substantially the desired flank angle of the finished thread.

* * * * *